US009567657B2

(12) United States Patent
Sugiyama et al.

(10) Patent No.: US 9,567,657 B2
(45) Date of Patent: Feb. 14, 2017

(54) AUSTENITIC CAST IRON, AUSTENITIC-CAST-IRON CAST PRODUCT AND MANUFACTURING PROCESS FOR THE SAME

(75) Inventors: Tomohei Sugiyama, Kariya (JP); Manabu Ishikawa, Kariya (JP); Mamoru Kojima, Kariya (JP); Kyoichi Kinoshita, Kariya (JP)

(73) Assignee: KABUSHIKI KAISHA TOYOTA JIDOSHOKKI, Kariya-shi, Aichi (JP)

( * ) Notice: Subject to any disclaimer, the term of this patent is extended or adjusted under 35 U.S.C. 154(b) by 637 days.

(21) Appl. No.: 13/695,719

(22) PCT Filed: May 18, 2011

(86) PCT No.: PCT/JP2011/002755
§ 371 (c)(1),
(2), (4) Date: Nov. 1, 2012

(87) PCT Pub. No.: WO2011/145339
PCT Pub. Date: Nov. 24, 2011

(65) Prior Publication Data

US 2013/0045127 A1 Feb. 21, 2013

(30) Foreign Application Priority Data

May 21, 2010 (JP) ..... 2010-117389

(51) Int. Cl.
*C22C 37/08* (2006.01)
*C22C 37/10* (2006.01)
(Continued)

(52) U.S. Cl.
CPC ..... *C22C 37/08* (2013.01); *C21C 1/10* (2013.01); *C21C 1/105* (2013.01); *C21D 5/00* (2013.01);
(Continued)

(58) Field of Classification Search
None
See application file for complete search history.

(56) References Cited

U.S. PATENT DOCUMENTS 3,598,576 A * 8/1971 Moore ..... C21C 1/10 420/30
4,547,336 A * 10/1985 Mahrus et al. ..... 419/31
(Continued)

FOREIGN PATENT DOCUMENTS

DE 10049598 A1 * 4/2002 ..... C22C 37/08
EP 2 184 372 A1 5/2010
(Continued)

OTHER PUBLICATIONS

DE 10049598 A1 machine translation.*
(Continued)

*Primary Examiner* — Keith Walker
*Assistant Examiner* — Stephani Hill
(74) *Attorney, Agent, or Firm* — Sughrue Mion, PLLC

(57) ABSTRACT

An austenitic cast iron including basic elements of C, Si, Cr, Ni, Mn and Cu; and the balance including Fe, inevitable impurities and/or a trace-amount modifier element, which is effective in improving a characteristic of the cast iron, in a trace amount; and structured by a base comprising an Fe alloy in which an austenite phase makes a major phase in ordinary-temperature region; wherein the basic elements fall within compositional ranges that satisfy the following conditions when the entirety of the cast iron is taken as 100% by mass: C: from 2.0 to 3.0%; Si: from 4.0 to 5.4%; Cr: from 0.8 to 2.0%; Mn: from 3.9 to 5.6%; Ni: from 17 to 22%; and Cu: from 0.9 to 1.6%.

14 Claims, 6 Drawing Sheets

(51) Int. Cl.

| | |
|---|---|
| ***B22D 25/06*** | (2006.01) |
| ***F01N 13/16*** | (2010.01) |
| ***C21C 1/10*** | (2006.01) |
| ***C22C 33/08*** | (2006.01) |
| ***C21D 5/00*** | (2006.01) |
| ***C22C 37/04*** | (2006.01) |

(52) U.S. Cl.

CPC ..... *C22C 33/08* (2013.01); *C22C 37/04* (2013.01); *C22C 37/10* (2013.01); *F01N 13/16* (2013.01); *F01N 2530/02* (2013.01); *F01N 2530/04* (2013.01); *F05D 2220/40* (2013.01)

(56) References Cited

U.S. PATENT DOCUMENTS

2006/0191604 A1* 8/2006 Itoh ..... C22C 37/04
148/321

2010/0284849 A1 11/2010 Sugiyama et al.

FOREIGN PATENT DOCUMENTS

| | | | |
|---|---|---|---|
| JP | 53-137818 | A | 12/1978 |
| JP | 56-58945 | A | 5/1981 |
| JP | 58-27951 | A | 2/1983 |
| JP | 59-113160 | A | 6/1984 |
| JP | 5-302141 | A | 11/1993 |
| WO | 2009/028736 | A1 | 3/2009 |

OTHER PUBLICATIONS

Effect of Impurities on Cast Iron. Tech Plier. www.techplier.com/effect-of-impuirities-on-cast-iron/. Accessed Oct. 28, 2015.*

Communication, dated Apr. 8, 2016, from the European Patent Office in European application No. 11783276.6.

* cited by examiner

AUSTENITIC CAST IRON, AUSTENITIC-CAST-IRON CAST PRODUCT AND MANUFACTURING PROCESS FOR THE SAME

CROSS REFERENCE TO RELATED APPLICATIONS

This application is a National Stage of International Application No. PCT/JP2011/002755 filed May 18, 2011, claiming priority based on Japanese Patent Application No. 2010-117389 filed May 21, 2010, the contents of all of which are incorporated herein by reference in their entirety.

TECHNICAL FIELD

The present invention is one which relates to an austenitic cast iron being excellent in terms of oxidation resistance, and to a cast product being comprised of that cast iron, and to a manufacturing process for the same.

BACKGROUND ART

It is often the case that members being formed as complicated configurations, and relatively large-size members are manufactured by means of casting; what is more cast products being made of relatively inexpensive cast irons (hereinafter being simply referred to as "cast products") are used frequently.

In cast iron, carbon (C) in the alloy whose major component is made of iron-carbon exceeds the maximum solid solubility limit in γ iron (e.g., about 2% by mass), and the cast iron is accompanied by eutectoid solidification. Usually, in order to improve the characteristics, such as the mechanical properties, corrosion resistance and heat resistance, various alloying elements are added. Such a cast iron is referred to as an alloy cast iron, and especially those cast irons with great alloying-element amounts are referred to as high-alloy cast irons. These high-alloy cast irons are usually divided into ferritic cast irons and austenitic cast irons roughly depending on the difference between the crystalline structures of their crystallizing bases.

Among them, since the austenitic cast irons are comprised of austenite phase (or γ phase) mainly, not to mention in high-temperature region, but in ordinary-temperature region as well, they are good in terms of heat resistance, oxidation resistance, corrosion resistance, and the like; and are moreover good in terms of ductility, toughness, and so forth. Accordingly, the austenitic cast irons are often used for members that are made use of in harsh environments such as high-temperature atmospheres. For example, speaking of the field of automobiles, turbocharger housings, exhaust manifolds, catalyst cases, and the like, are given. Any of the members are a component part, and so on, respectively, which is exposed to high-temperature exhaust gases, and consequently which is required to exhibit long-term durability.

By the way, various types are available in the austenitic cast irons as well, and the following are representative ones: Niresist, nimol, nicrosilal, monel, minober, nomag, and the like. Moreover, in Japanese Industrial Standards (i.e., JIS), too, 9 types are prescribed for the flake graphitic cast iron (e.g., FCA), and 14 types are prescribed for the spheroidal graphitic cast iron (e.g., FCDA).

In the conventional austenitic cast irons, an austenite phase has been made obtainable even in ordinary-temperature region by having them contain nickel (Ni), namely, an austenite stabilizing element, in a large amount (Ni: from 18 to 36%, for instance). This Ni is expensive considerably compared with iron (Fe), namely, the parent material, and the other alloying elements, and consequently cast products comprising the conventional austenitic cast irons have been highly costly considerably.

For example, a Niresist cast iron being referred to as "D-5S," which is equivalent to FCDA-NiSiCr3552 according to JIS, is high in terms of austenite-phase stability, and exhibits good oxidation resistance, too, because it includes Ni in a large amount. Moreover, like a Niresist cast iron being referred to as "D-2" that is equivalent to FCDA-NiCr202 according to JIS, austenitic cast irons whose Ni contents are less comparatively have also come to be known publicly. However, the Niresist cast iron that is equivalent to FCDA-NiCr202 is poor in term of oxidation resistance. Consequently, it is unsuitable for a housing for variable nozzle turbocharger (e.g., "VNT™)," being called a variable capacity turbocharger as well), for instance. The VNT™ is a type of turbocharger. It makes the opening areas of a plurality of variable nozzles, which are disposed on the outer side of an exhaust turbine within the housing, variable in compliance with the revolving speeds of an engine, and controls the flow volume of exhaust gases to change the supercharging efficiency, thereby adjusting the revolving speeds of the exhaust turbine. In the VNT™, since the clearance between the housing and the turbine blades affects the flow volume of exhaust gases greatly, the housing's oxidation resistance is important from the viewpoint of securing a given dimension for the clearance. Moreover, there might also be concerns for oxides that have come off from the housing to be bitten between the turbine blades' movable parts so that the turbine blades have come to be unmovable or have been damaged. In addition, since the turbocharger housing as well as exhaust manifolds are component parts that are employed for an exhaust system, the oxides also become a cause of clogging honeycomb supports for exhaust-gas conversion catalyst when they are bulky large-sized ones.

As a cast iron being good in terms of corrosion resistance, Patent Literature No. 1 sets forth a highly-heat-insulating corrosion-resistant cast iron including C in an amount of from 0.8 to 2.0%. Silicon (Si) is added in order to upgrade the heat-insulating property. Moreover, from the viewpoint of corrosion resistance, chromium (Cr) and copper (Cu) are made to be contained. Although Patent Literature No. 1 does not at all refer to the relation between the hardness and composition of cast iron, the cast iron labeled Nos. 1 through 9, which are set forth in the examples, are all unsuitable for processing operations, because any one of them is of high hardness (e.g., about 280 Hv or more by Vickers hardness). Moreover, in Patent Literature No. 1, the cast iron's heat-insulating property is upgraded by making the C content less than those in usual cast irons. In particular, when focusing on the C amount, since the C amounts are from 0.8 to 1.0% in the alloys according to the respective examples being set forth in Patent Literature No. 1, those being disclosed in Patent Literature No. 1 can be referred to as cast steels rather than cast irons.

Moreover, Patent Literature No. 2 discloses an austenitic cast iron whose Si amount is augmented whereas the Ni amount is made much less than that in the foregoing Niresist cast iron. Patent Literature No. 2 discloses that, regarding oxidation resistance, one of the indexes of heat resistance for austenitic cast iron, as the Si amount is augmented, the oxidized weight increase per unit surface area decreases (see FIG. 6 in Patent Literature 2). However, according to studies by the present inventors, when the Si amount becomes excessive, it results in bringing about decline in the elongation of austenitic cast iron, and in deterioration of the machinability. Accordingly, taking the reliability, mass-producibility, and the like, of heat-resistant members comprising austenitic cast irons, it is not realistic at all to simply adjust the Si amount alone in order to enhance the oxidation resistance up to a practically sufficient level.

Hence, the present inventors disclosed an austenitic cast iron in Patent Literature No. 3, austenitic cast iron whose Ni content is less, and which is excellent not only in terms of thermal-fatigue strength, and the like, but also in terms of oxidation resistance. In the austenitic cast iron being set forth in Patent Literature No. 3, the Ni amount becomes a considerably small amount (i.e., the upper limit is 15%) as a whole of the cast iron. From the viewpoint of conventional technical common senses, it seems that no base, in which an austenite phase being stable in ordinary-temperature region makes a major phase, is obtainable. However, they succeeded in obtaining an austenite phase, whose Ni content was even a smaller amount than those conventional ones, by setting the respective contents of C (especially, $C_s$, a solute carbon content), Si, Cr, manganese (Mn) and Cu, namely, alloying elements other than Ni, so as to fall in appropriate ranges.

RELATED TECHNICAL LITERATURE

Patent Literature

Patent Literature No. 1: Japanese Unexamined Patent Publication (KOKAI) Gazette No. 5-302141;

Patent Literature No. 2: Japanese Unexamined Patent Publication (KOKAI) Gazette No. 58-27951; and Patent Literature No. 3: International Publication Pamphlet No. WO2009/028736

SUMMARY OF THE INVENTION

Assignment to be Solved by the Invention

However, it was understood that some of the austenitic cast irons with the compositions being disclosed in Patent Literature No. 3 did not exhibit oxidation resistance sufficiently under high temperature (at 850° C., for instance). In addition, according to studies by the present inventors, it was understood anew that, in the austenitic cast irons with compositions being disclosed in Patent Literature No. 3, increasing the Si addition amount led to declining the austenite proportions greatly after being retained in an intermediate-temperature region of from 500 to 600° C. approximately for a long period of time. The decline of austenite proportion arises mainly from such a phase transformation as austenite ($\gamma$)→ferrite ($\alpha$). Increasing the ferrite phase leads to bringing about the embrittlement of cast iron and the occurrence of transformative strain. That is, it is needed to further develop the invention being set forth in Patent Literature No. 3.

The present invention is one which has been done in view of such circumstances. Specifically, it is an object to provide an austenitic cast iron that is an austenitic cast iron whose Ni content is less relatively, and which is excellent in terms of oxidation resistance under high temperature and in terms of austenite-phase stability in intermediate-temperature region. Moreover, in addition to that, it is another object to provide austenitic cast products comprising that austenitic cast iron, and a manufacturing process for the same.

Means for Solving the Assignment

In general, it has been known that increasing an addition amount of Cr and/or Si leads to upgrading oxidation resistance. The present inventors studied earnestly on the Fe—C—Si—Ni—Mn—Cu—Cr alloy being set forth in Patent Literature No. 3 in order to solve the above-mentioned assignment; as a result of their repeated trial and error, they found out that, under a high temperature of 850° C. approximately, increasing the Si addition amount is more effective for upgrading oxidation resistance than increasing the Cr addition amount. However, it was understood anew that, when adding Si in a greater amount in order to upgrade the oxidation resistance in the Fe—C—Si—Ni—Mn—Cu—Cr alloy being set forth in Patent Literature No. 3, the austenite proportion lowers greatly after being retained in an intermediate-temperature region of from 500 to 600° C. approximately for a long period of time. Based on these new viewpoints, the present inventors succeeded in obtaining an austenitic cast iron, in which the oxidation resistance under high temperature and the austenite-phase stability in intermediate-temperature region are compatible with each other, by setting the addition amounts of C, Si, Cr, Mn and Cu, especially, the addition amount of Si, so as to fall in appropriate ranges, while being on the premise that the Ni amount is less than that in the conventional Niresist cast iron (i.e., "D-5S") that is good in terms of oxidation resistance and austenite-phase stability.

Specifically, an austenitic cast iron according to the present invention is characterized in that:

it comprises:

basic elements comprising carbon (C), silicon (Si), chromium (Cr), nickel (Ni), manganese (Mn) and copper (Cu); and the balance comprising iron (Fe), inevitable impurities and/or a trace-amount modifier element, which is effective in improving characteristic, in a trace amount;

it is an austenitic cast iron being a cast iron that is structured by a base comprising an Fe alloy in which an austenite phase makes a major phase in ordinary-temperature region;

wherein said basic elements fall within compositional ranges that satisfy the following conditions when the entirety of said cast iron is taken as 100% by mass (hereinafter being simply expressed as "%"):

C: from 2.0 to 3.0%;

Si: from 4.0 to 5.4%;

Cr: from 0.8 to 2.0%;

Mn: from 3.9 to 5.6%;

Ni: from 17 to 22%; and

Cu: from 0.9 to 1.6%.

For example, FIG. 1 relates to oxidized weight reductions after an Fe—C—Si—Ni—Mn—Cu—Cr alloy was left in 750° C., 800° C. or 850° C. air for 100 hours, and is a graph that illustrates partial regression coefficients when a multiple classification analysis was carried out in which the added mass percentages of the respective elements made the variables. Note that a measurement method for the oxidized weight reductions were the same as a method being described later (see the section of "EXAMPLES"). The vertical axis of the graph in FIG. 1 specifies a variation in the oxidized weight reduction when each of the elements was added in an amount of 1% by mass; and the positive values indicate the case of being more likely to be oxidized, whereas the negative values indicate the case of being less likely to be oxidized. As can be seen from FIG. 1, although the increasing Si amount led to upgrading the oxidation resistance, the oxidation resistance at 850° C. upgraded especially remarkably. However, the addition of Ni hardly had an effect on the oxidation resistance.

Moreover, FIG. 2 relates to variations of BCC transformation driving force in an Fe—C—Si—Ni—Mn—Cu—Cr alloy in an intermediate-temperature region of 500° C. or 600° C., and is a graph that illustrates partial regression coefficients when a multiple classification analysis was carried out in which the added mass percentages of the respective elements made the variables. Note that the "BCC transformation driving force" refers to being equivalent to a Gibbs-free-energy variation when austenite having FCC structure transforms into ferrite having BCC structure (i.e., $G_{fcc}-G_{bcc}=\Delta G$), and is a value calculated from the theoretical values. The vertical axis of the graph in FIG. 2 specifies a variation in the BCC driving force when each of the elements was added in an amount of 1% by mass; and the positive values indicate a case where the resulting alloy became less likely to transform from austenite to ferrite, whereas the negative values indicate another case where the resultant alloy became more likely to transform from austenite to ferrite. As can be seen from FIG. 2, the increasing Si amount led to declining the austenite-phase stability greatly. On the other hand, the addition of the other elements, especially, the addition of Ni and Mn, stabilizes the austenite phase in the intermediate-temperature region.

In other words, in the austenitic cast iron according to the present invention, adding Mn, Cu and Cr compositely to it while letting it contain Si to such an extent that makes it possible to maintain the oxidation resistance at high temperatures results in making it possible for the present austenitic cast iron to stabilize the austenite phase even in intermediate-temperature region, not to mention at ordinary temperature, by a relatively less Ni content. Consequently, in the austenitic cast iron according to the present invention, the austenite-phase stability in intermediate-temperature region, and the excellent oxidation resistance at high temperatures can be made compatible with each other even when the Ni content is less relatively.

Incidentally, the phenomenon, the decrease of austenite proportion in intermediate-temperature region in austenitic cast iron, is a phenomenon to which nobody has been paying attention so far. This is because of the fact that cracks, deformations, and the like, which result from the increase of ferrite phase, do not occur even when austenitic cast iron is left in a high-temperature region of 700° C. or more for a long period of time. That is, it is presumed that austenite phase is stable without ever being affected greatly by the composition in a high-temperature region of 700° C. or more even when being retained therein for a long period of time. This fact becomes definite when calculating the BCC transformation driving forces theoretically for temperatures. FIG. 3 is a graph that shows the stability of austenite phase in various kinds of austenitic cast irons (the symbols in the diagram are identical with Test Specimen Nos. being described later), and illustrates the temperature dependency of the BCC transformation driving forces (i.e., ΔG) that were obtained by means of theoretical calculation. In this graph, it is possible to say that, when ΔG is a positive value, the resulting austenite phase is stable theoretically. Although the graph in FIG. 3 shows ΔG variations in six types of austenitic cast irons, the higher the temperature is, the greater the value of ΔG becomes in any of the austenitic cast irons. Accordingly, the variations become $\Delta G>0$ at 700° C. or more. Moreover, when an austenite proportion in Test Specimen "C4" was calculated actually by a method being described later after it had been heat-treated at 700° C. for 300 hours, the resulting austenite proportion was high because it became 87%. Therefore, in the austenitic cast iron according to the present invention whose austenite-phase stability in intermediate-temperature region has been enhanced, cracks, and the like, are less likely to occur even when retaining it in regions of from intermediate temperatures up to high temperatures.

Moreover, the austenitic cast iron according to the present invention that falls within the above-mentioned compositional ranges can sufficiently demonstrate such mechanical characteristics as proof stress, tensile strength and elongation, too.

Note that, in the present invention, the "austenite phase" is not necessarily needed to be an austenite single phase completely. That is, the clauses, an "austenite phase makes a major phase" and an "austenite phase is stable," purport to make the following cases permissible: not to mention the case where austenite makes 100% by X-ray diffraction (or XRD) and it comprises an austenite single phase alone that does not include any lamellar structure comprising those such as martensite and pearlite in the austenite; and, in addition to the former, cases where the austenite includes martensite phases, and the like, slightly. Therefore, when trying to prescribe an austenite proportion, it is advisable that, of diffraction peaks being obtainable by means of XRD measurement, an area of the peak resulting from austenite phase (namely, an austenite proportion) can be more than 50%, 60% or more, 70% or more, 80% or more, 90% or more, or furthermore 95% or more, when a sum of the area of the peak resulting from austenite phase and the other area of the peak resulting from ferrite phase is taken as 100%. Note that the areas of the peaks can be calculated from results of the XRD measurement.

Moreover, the present invention can be grasped not only as the above-described austenitic cast iron but also as austenitic cast products comprising that austenitic cast iron. As one of examples of the austenitic cast products according to the present invention, members, such as exhaust-system component parts and the like, which are to be exposed to high-temperature environments, can be given.

In addition, the present invention can also be grasped as a manufacturing process for those austenitic cast products as well. Specifically, it is advisable that the present invention can also be a manufacturing process for austenitic cast product being characterized in that it comprises:

a molten-metal preparation step of preparing a molten metal with the compositional range being described above;

a pouring step of pouring the molten metal into a casting die; and a solidification step of cooling the molten metal that has been poured into the casting die, and then solidifying the molten metal;

wherein a cast product comprising the above-described austenitic cast iron according to the present invention is obtainable.

By the way, in expanding applications of the austenitic cast iron (or cast product) according to the present invention, it is also often the case to add various modifier elements at the time of casting. For example, it is often the case that an auxiliary agent is added in order to increase the number of graphite particles that crystallize in structures of the base, or in order to spheroidize their configurations. Hence, it is also advisable that the manufacturing process for austenitic cast product according to the present invention can even be one being characterized in that it comprises:

a modifier-free-molten-metal preparation step of preparing a modifier-free molten metal comprising a molten metal with the compositional range being described above;

an auxiliary-agent addition step of adding an auxiliary agent, which includes at least one member being selected from the group consisting of inoculant agents that make cores of graphite to be crystallized or precipitated, and spheroidizing agents that facilitate spheroidizing of the graphite, to the modifier-free molten metal directly or indirectly;

a pouring step of pouring a molten metal, which has underwent the auxiliary-agent addition step or is undergoing the auxiliary-agent addition step, into a casting die; and a solidification step of cooling the molten metal that has been poured into the casting die, and then solidifying the molten metal;

wherein a cast product comprising the aforesaid austenitic cast iron is obtainable, the austenitic cast iron in which substantially spheroidal graphite is crystallized or precipitated within the resulting base.

Effect of the Invention

The austenitic cast iron according to the present invention is excellent in terms of the oxidation resistance under high temperature and the austenite-phase stability in intermediate-temperature region, although the Ni content is less relatively.

MODE FOR CARRYING OUT THE INVENTION

Figure 1:
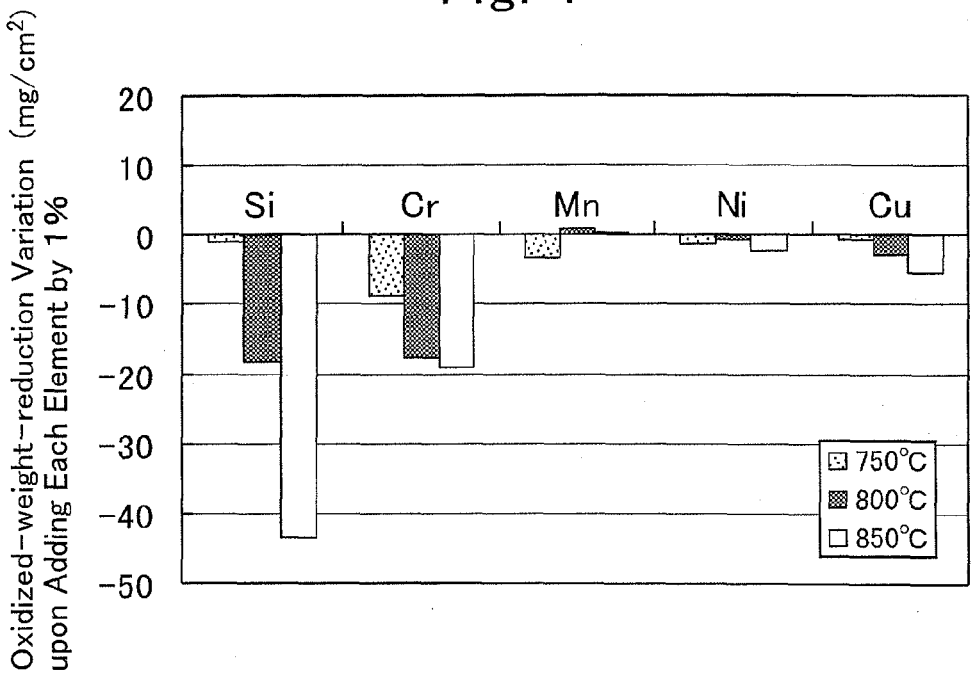
FIG. 1 is a graph that illustrates partial regression coefficients when a multiple classification analysis was carried out in which the added mass percentages of the respective elements in an Fe—C—Si—Ni—Mn—Cu—Cr alloy made the variables, and is results of evaluating the oxidation resistance by the value of change in the oxidized weight reductions.

Hereinafter, explanations will be made on some of the best modes for performing the austenitic cast iron according to the present invention and a manufacturing process for the same as well as the austenitic cast product according to the present invention. Note that, unless otherwise specified, ranges of numeric values, "from 'x' to 'y'" being set forth in the present description, involve the lower limit, "x," and the upper limit, "y," in those ranges. And, the other ranges of numeric values are composable by arbitrarily combining values that involve not only those upper-limit values and lower-limit values but also numerical values that are listed in the following examples.

Austenitic Cast Iron

Composition

An austenitic cast iron according to the present invention comprises basic elements, and Fe, namely, the balance. The basic elements comprise six types of elements, namely, C, Si, Cr, Mn, Ni and Cu. Hereinafter, the actions or functions of each of these respective elements, and their suitable compositions will be explained.

C drops the molten temperature of Fe, and enhances the flowability of molten metal (including modifier-free molten metal). Accordingly, it is an indispensable element for ferrous casting. Since C in Fe—C system alloys exceeds the maximum solid-solubility limit in γ iron so that cast irons are accompanied by eutectic solidification, the lower limit of C amount can be 1% fundamentally, and C crystallizes as graphite when it exceeds the solid-solubility limit. However, when the C amount is too little, no preferable castability is obtainable because the flowability of molten metal has declined. Hence, it is advisable to set the C amount at 2.0% or more (i.e., the maximum solid-solubility limit or more), 2.1% or more, or furthermore 2.2% or more. It can preferably be 2.3% or more, or more preferably be 2.4% or more. When the C amount is too much, the resulting base's structure decreases, and thereby the resulting austenitic cast iron's mechanical characteristics, and the like, decline. In particular, the C amount affects the hardness of austenitic cast iron, and eventually the workability of austenitic cast iron. Moreover, cast defects, such as shrinkage cavities, become likely to occur at the time of casting. Hence, the C amount can preferably be 3.0% or less, more preferably be 2.9% or less, 2.8% or less or 2.7% or less, much more preferably be 2.6% or less.

Si lowers the eutectic temperature of metastable system, facilitates the eutectic crystallization of γ Fe-graphite, and then contributes to the crystallization of graphite. Moreover, Si forms passive films, which comprise silicon oxide, in the vicinity of crystallizing graphite's surface, and thereby enhances the oxidation resistance of cast iron. In particular, it has been already mentioned as above it highly exhibits the effect of upgrading the oxidation resistance at high temperatures. However, when the Si amount is too little, the effect of upgrading the oxidation resistance is not obtainable sufficiently. Consequently, it is allowable that the Si amount can be set at 4.0% or more, or furthermore 4.1% or more. When much higher oxidation resistance is needed, it is permissible that it can be set at 4.2% or more, 4.3% or more, or furthermore 4.5% or more. As having been detailed already, since ferrite is likely to generate in intermediate-temperature region when Si is too much, the Si amount can be set at 5.4% or less, or furthermore 5.3% or less. In addition, the resulting thermal-fatigue strength and elongation at room temperature tend to decline when the Si amount is too much, it is preferable that the Si amount can be 5.1% or less, or furthermore 5.0% or less.

Note that it is also possible to prescribe the flowability of molten metal by means of a carbon equivalent (%), namely, $C_{eq}$=C+Si/3, which is calculated from a C content (%) and an Si content (%). In general casting facilities, the temperature of outgoing molten metal is set up in a range of from 1,500 to 1,550° C. However, taking mass-producibility into consideration, it is desirable to keep the melting point of molten metal down to 1,350° C. or less in order for securing the flowability, because of the fact that the temperature decline, which occurs during continuous pouring into casting die, is 100° C. or more, and moreover because of the fact that the temperature decline, which results from the addition of auxiliary agent, is 100° C. approximately. Although a phase diagram has been unknown in the compositional ranges of the austenitic cast iron according to the present invention, the melting point of molten metal would become 1,350° C. or less as far as C is 4.0% or less, when thinking of it using an equilibrium diagram being cut at 2.4%-by-mass Si in an Fe—C phase diagram that has been employed commonly in cast ions. Since carbon is in a solved state when C is less than 1.2%, there might be a fear that graphite does not necessarily crystallize at any cooling rate of molten metal. From the above facts, when "$C_{eq}$" is set at from 2.0 to 4.8%, the molten-metal flowability is good, and so the formation of shrinkage cavities can be suppressed. Taking the following facts into consideration: the melting point becomes the lowest at around the eutectic point; and the control width for the addition amount of alloying element in mass production is ±0.3% approximately for C and ±0.5% approximately for Si, more preferable "$C_{eq}$" can be from 3.6 to 4.6%.

Cr binds with carbon in cast-iron base to precipitate carbides therein, and then upgrades the high-temperature proof stress of cast iron by means of the precipitation strengthening of the resulting base. Moreover, it makes it possible to upgrade the oxidation resistance because it forms passive films, which comprise dense chromium oxides, in the vicinity of the resulting cast iron's surface. Consequently, it is allowable that the Cr amount can be set at 0.8% or more, or furthermore 0.9% or more. In a case where further oxidation resistance is sought for, it is permissible that it can be set at 1.0% or more, 1.3% or more, or furthermore 1.4% or more. However, Cr being too much is not preferable because not only the resultant thermal-fatigue strength declines but also carbides increase to be harder so that the resulting toughness and workability decline. Hence, the Cr amount can be set at 2.0% or less, and can preferably be 1.9% or less, or furthermore 1.7% or less, 1.6% or less or 1.5% or less.

In addition to being effective in the stabilization of austenite structure, Mn is also an effective element in the removal of S, or the like, which becomes the cause of flowability worsening and embrittlement. Moreover, since martensite is likely to generate when Mn is too little, the lower limit of the Mn amount is 1.5% basically. However, even when Mn is included in an amount of more than 1.5%, ferrite is likely to generate in intermediate-temperature region in a case where an Si content is much and an Ni content is less. Consequently, it is advisable that the Mn amount can be 3.9% or more, or furthermore 4.0% or more. On the other hand, when the Mn amount is excessive, Mn carbides increase to cause the decline in the toughness and so forth of cast iron, or the decline in heat resistance. Moreover, that is not preferable, because gas defects, such as blow holes, become likely to occur. Moreover, the resulting thermal-fatigue strength declines. It is preferable that the Mn amount can be 5.6% or less, or furthermore 5.2% or less or 5.0% or less.

Ni is an effective element in the austenitization of base's structure. However, as described above, it is hard to obtain stable austenite phase in intermediate-temperature region when Ni is too little. Consequently, it is advisable that the Ni amount can be set at 17% or more, or furthermore 19% or more. In addition, since it is possible to reduce the resulting hardness in order to upgrade the resultant thermal-fatigue strength by means of the addition of Ni, it is preferable that the Ni amount can be 19.5% or more, or furthermore 20% or more. However, in the austenitic cast iron according to the present invention, making austenite inexpensive is intended by reducing the Ni amount. It is preferable that the Ni amount can be 22% or less, or furthermore 21.5% or less or 21% or less.

Figure 2:
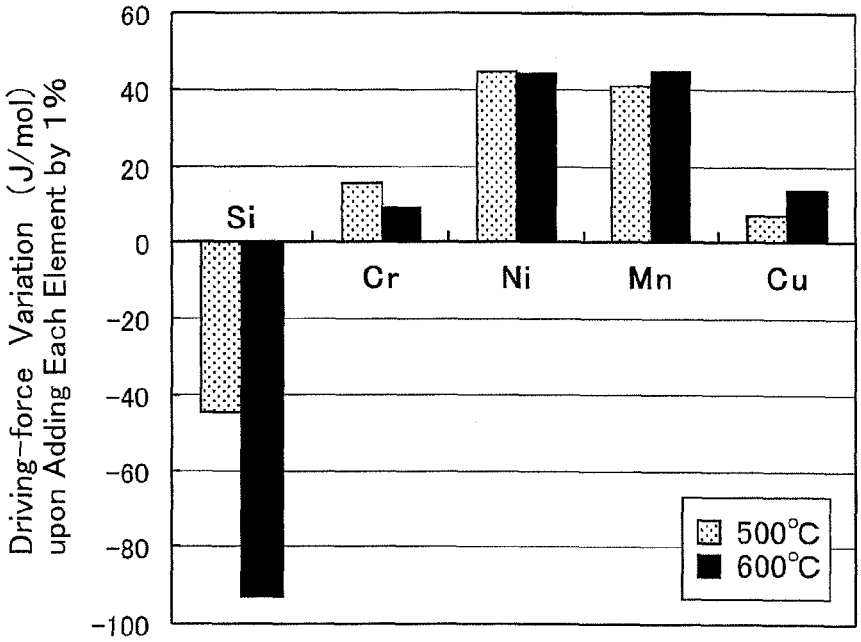
FIG. 2 is a graph that illustrates partial regression coefficients when a multiple classification analysis was carried out in which the added mass percentages of the respective elements in an Fe—C—Si—Ni—Mn—Cu—Cr alloy made the variables, and is results of evaluating the austenite-phase stability by the value of change in the BCC transformation driving forces.
Figure 3:
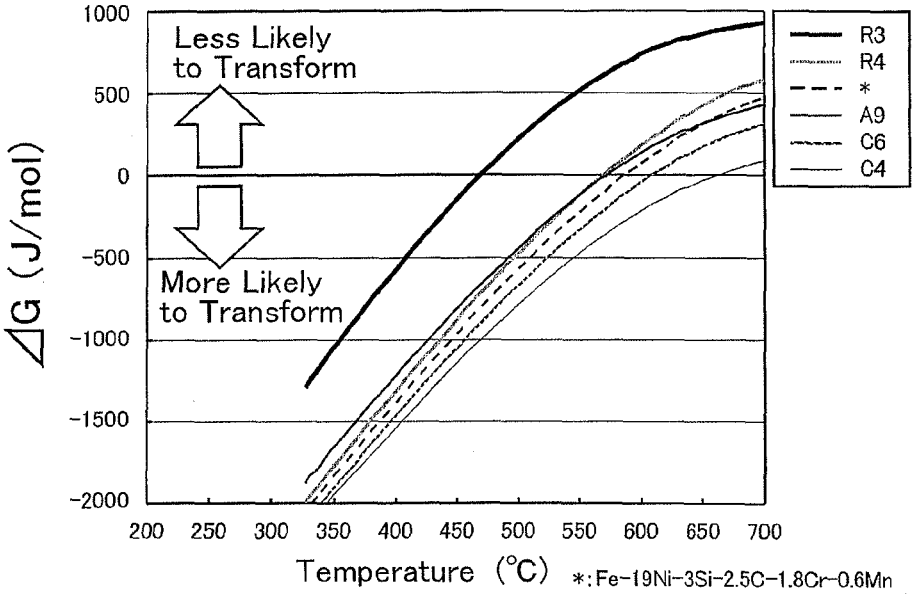
FIG. 3 is a graph that illustrates the austenite-phase stability of various austenitic cast irons with respect to temperatures.

Moreover, as can be seen from FIG. 2, Mn has an effect of upgrading the stability of austenite phase in intermediate-temperature region to the same extent as does Ni. Consequently, when prescribing (Ni+Mn), a summed amount of the addition amounts of Ni and Mn, it is preferable that the summed amount can be from 21% or more to 27% or less. Setting (Ni+Mn) at 21.5% or more or 23% or more, or furthermore 24% or more, is preferable, because it is possible to secure the stability of austenite phase in intermediate-temperature region even when the Si addition amount is much relatively. On the other hand, when the Si addition amount falls in the above-mentioned ranges, it is even feasible to reduce (Ni+Mn) down to 26% or less, or furthermore 25.5% or less.

Not only Cu solves into base and then stabilizes austenite structure as well as Ni, but also Cu refines the crystalline grains in base's structure to upgrade the resulting high-temperature proof stress. Moreover, it is an effective element in upgrading the resultant oxidation resistance and corrosion resistance as well as in upgrading the resulting thermal-fatigue strength. Consequently, it is allowable that a Cu amount can be 0.9% or more, or can preferably be 1.0% or more, or can more preferably be 1.2% or more. However, when Cu becomes excessive, the peritectic structure of Cu appears so that the spheroidizing of graphite is hampered to decline the strength and the like of cast iron. Moreover, Cu that becomes excessive is not preferable, because the peritectic structure of Cu appears and thereby the elongation performance at the time of high temperatures worsens. In addition, adding Cu excessively tends to decline the stability of austenite phase at high temperatures (700° C., for instance). Hence, it is permissible that the Cu amount can be 1.6% or less, or can preferably be 1.5% or less, or can more preferably be 1.4% or less.

Figure 4:
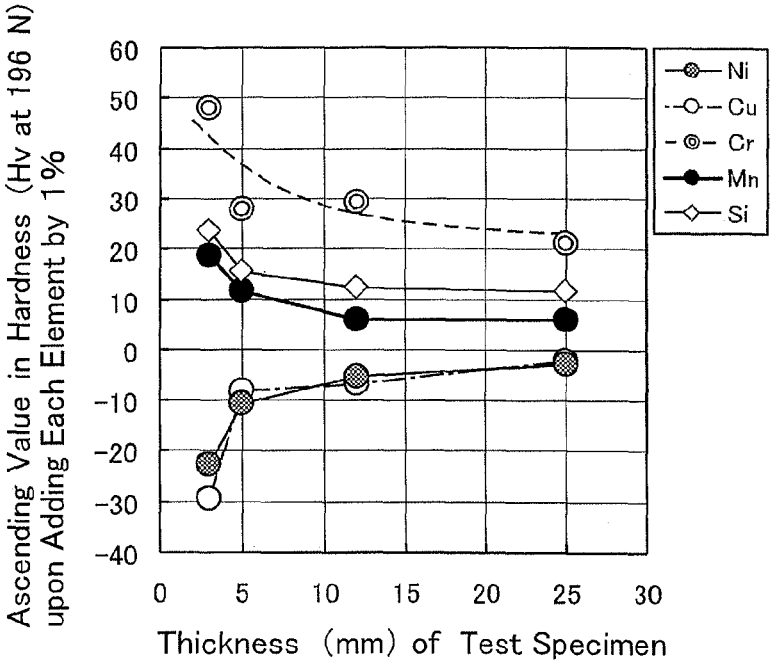
FIG. 4 is a graph that illustrates partial regression coefficients when a multiple classification analysis was carried out in which the added mass percentages of the respective elements in an Fe—C—Si—Ni—Mn—Cu—Cr alloy made the variables, and is results of evaluating the Vickers hardness by the value of change in the Vickers hardness with respect to the plate thickness of test specimen.

By the way, FIG. 4 is a graph that illustrates correlations between ascending values in the hardness of each of test specimens and the thickness of the test specimens. The correlations are based on partial regression coefficients when a multiple classification analysis, in which the added mass percentages of the respective elements in an Fe—C—Si—Ni—Mn—Cu—Cr alloy made the variables, was carried out for every one of the test specimens with 25 mm, 12 mm, 5 mm and 3 mm in thickness. Note that the method of measuring the hardness was the same as a method being described later. The ascending values are expressed with reference to an Fe-3% C-4% Si alloy's hardness; they are expressed by positive values when the resulting hardness was harder than the reference, and are expressed by negative values when the resultant hardness was lower than the reference. As can be seen from FIG. 4, the additions of Cr, Mn and Si raise the hardness of austenitic cast iron, and become the cause of embrittlement. On the other hand, the additions of Ni and Cr lower the hardness of austenitic cast iron, and thereby the ductility upgrades.

In the austenitic cast iron according to the present invention, it is also a characteristic point that the Mn addition amount is kept down in order for upgrading the ductility. However, as described earlier, when the addition of Mn is too low, the stability of austenite phase in intermediate-temperature region declines. As can be seen from FIG. 2, the stability of austenite phase in intermediate-temperature region can be kept by adding Ni and Cu. In addition, the additions of Ni and Cu upgrade the resulting ductility. That is, in the austenitic cast iron according to the present invention, adding Ni and Cu compensates for the decline in the austenite-phase stability in intermediate-temperature region, decline which results from reducing the Mn addition amount, and thereby the ductility upgrades furthermore.

The austenitic cast iron according to the present invention has a moderate hardness by setting the contents of the respective additive elements so as to fall in appropriate ranges. When prescribing the hardness of the austenitic cast iron, it is preferable that the hardness can be from 130 to 250 Hv by Vickers hardness, or furthermore from 140 to 220 Hv or from 150 to 200 Hv. The hardness going beyond 250 Hv is not preferable, because not only the resulting thermal-fatigue strength declines but also the resultant elongation and tensile strength decline. Moreover, the austenitic cast iron, which exhibits a moderate hardness and a sufficient elongation, is excellent in terms of workability.

Trace-Amount Modifier Element

It is preferable to make a trace-amount element be contained in order to improve a variety of characteristics, such as the metallic structure of austenitic cast iron (or cast product), the oxidation resistance, the corrosion resistance, the mechanical characteristics, like strength or toughness, in ordinary-temperature region or high-temperature region, and electric characteristics. Austenitic cast irons that include such a modifier element also fall within the scope of the present invention naturally as far as the basic elements fall within the above-described ranges.

The trace-amount modifier element can be the following: magnesium (Mg), rare-earth elements (or R.E.), aluminum (Al), calcium (Ca), barium (Ba), bismuth (Bi), antimony (Sb), tin (Sn), titanium (Ti), zirconium (Zr), molybdenum (Mo), vanadium (V), tungsten (W), niobium (Nb), or nitrogen (N), and the like, for instance. The content of each of these elements can be adjusted appropriately depending on characteristics that are required for austenitic cast irons. However, from the viewpoints of influences and so forth to costs and the compositions of the basic elements, it is preferable that the trace-amount modifier elements can be 1% or less, 0.8%, or furthermore 0.6% or less approximately, in a total content.

An added trace-amount modifier element might possibly disappear and the like during casting, because the melting point is lower than that of Fe. Accordingly, the content of each of the respective elements does not necessarily coincide with the total addition amount of that element. Therefore, as far as being effective in the improvement and so forth of cast structure, it is advisable that the content of that trace-amount modifier element can even be at the minimum level that is detectable.

A representative trace-amount modifier element is each of the respective elements that are included in an inoculant agent, which facilitates the crystallization of graphite within Fe base, or a spheroidizing agent, which facilitates the spheroidizing of resultant crystallized graphite. An auxiliary agent, such as an inoculant agent or spheroidizing agent, is blended at the time of preparing a molten metal, or is added appropriately at the time of casting. However, its contained elements and the contents of the respective elements are not fixed, but vary greatly. That is, it is the actual situation however that they are sought by trial and error in order to obtain desired cast structures (e.g., the configurations of crystallizing graphite or the number of their particles especially), and the like. Therefore, it is difficult to clearly identify the type of the trace-amount modifier elements and their contents. And, adhering to the type of the trace-amount modifier elements and the contents is against the true aim of the present invention.

However, Mg and R.E. (e.g., cerium (Ce) especially) have been known publicly as spheroidizing agents for crystallizing graphite. Hence, in the case of the austenitic cast iron according to the present invention as well, it is preferable to include Mg in an amount of from 0.01 to 0.1% and/or Ce in an amount of from 0.005 to 0.05%, Mg and Ce which serve as a trace-amount modifier element respectively, relative to the entire cast iron being taken as 100%.

Here, since Mg is likely to disappear from inside high-temperature molten metals, it is preferable that the addition amount can be adjusted to such an extent that its lower limit becomes 0.02%, or furthermore 0.03%, relative to the entire cast iron being taken as 100%. Although the upper limit of the Mg content is not limited especially as far as it does not affect the compositions of the basic elements, it can be, in actuality however, 0.07%, or furthermore 0.06%, relative to the entire cast iron being taken as 100%.

Since Ce, one of R.E., is expensive, and moreover since the effect of spheroidizing is obtainable even when being included in a small amount (e.g., 0.001% or more), it is preferable that the upper limit of Ce can be 0.03%, or furthermore 0.01%, relative to the entire cast iron being taken as 100%. Although the lower limit of Ce is not limited especially as far as it falls in a range in which the effect of serving as a spheroidizing agent is obtainable, its lower limit can be, in actuality however, 0.007%, or furthermore 0.008%, relative to the entire cast iron being taken as 100%.

Inevitable Impurities

As inevitable impurities, phosphorous (P), and sulfur (S) are given, for instance. P is harmful to the spheroidizing of graphite, and moreover precipitates in crystal grain boundaries to decline the resulting oxidation resistance and room-temperature elongation. S is also harmful to the graphitic spheroidizing. Therefore, it is preferable that each of these inevitable impurities can be set at 0.05% or less, 0.03% or less, 0.02% or less, or furthermore 0.01% or less.

Manufacturing Process for Austenitic-Cast-Iron Cast Product

Since the present invention is a manufacturing process for austenitic cast product, it is equipped with a molten-metal preparation step, a pouring step, and a solidification step that are like those as described earlier. However, in the case of manufacturing members, such as automotive component parts for which high reliability is required, with cast products, it is required that the austenitic cast iron according to the present invention be a spheroidal graphite cast iron. Hence, it is desired to crystallize a large number of spheroidal graphite finely and minutely within base that comprises austenite phase, and accordingly the blend or addition of auxiliary agent, such as an inoculant agent or spheroidizing agent, is done.

These auxiliary agents have been blended beforehand from the stage of the molten-metal preparation step, for instance. However, in order to prevent the disappearance of those auxiliary agents, and such a fading phenomenon that the effects of the auxiliary agents reduce as being accompanied by the elapse of time, and in order to make the auxiliary agents function effectively, it is more suitable to first prepare such a molten metal, which comprises the basic elements, previously (i.e., a modifier-free-molten-metal preparation step), and then to be equipped with an auxiliary-agent addition step of blending an auxiliary agent with or adding it to that modifier-free molten metal directly or indirectly.

Here, the case of adding an auxiliary agent "directly" is such a case where it is added to the modifier-free molten metal before pouring it into a casting die, and the like. Moreover, the case of adding or the like an auxiliary agent "indirectly" is such a case where it is charged in a cavity of casting die in advance, and so forth. For example, when being the case of inoculating, it is advisable to do it by any one of the following: ladle inoculation, inoculating inside casting die, wire inoculation, and so on. It is the same in the case of spheroidizing treatment, too.

After all, since ordinary cast products are cast by injecting the molten metal (or modifier-free molten metal) into a ladle from a melting furnace or retaining furnace and then pouring that molten metal into a casting die, it is also advisable that the addition of an auxiliary agent can be carried out at any one of those stages. Moreover, it is even allowable that the auxiliary agent can have any one of powdery shapes, granular shapes, wired shapes, and the like. Note that, although the auxiliary agent can be represented by inoculant agents and spheroidizing agents, it can be additive agents other than these.

In view of the composition elementally, it is preferable that the inoculant agent can comprise one or more members of Si, Ca, Bi, Ba, Al, Sn, Cu, or R.E., for instance. To be concrete, the following inoculant agents are available: Si—Ca—Bi—Ba—Al-system ones, Si—Ca—Bi—Al-R.E.-system ones, Si—Ca—Al—Ba—system ones, Si—Sn—Cu-system ones, and the like. The addition amount or blended amount of inoculant agent is determined in consideration of the disappearance, the fading phenomenon, and so forth. Hence, it is preferable to set so that the total addition amount becomes from 0.05 to 1%, for instance, when the entire modifier-free molten metal is taken as 100%.

In view of the composition elementally, it is preferable that the graphite spheroidizing agent can comprise one or more members of Mg, and R.E., for instance. To be concrete, the following spheroidizing agents are available: Mg-R.E.-system ones, Mg simple substance, R.E. simple substances such as misch metal (or Mm), Ni—Mg-system ones, Fe—Si—Mg-system ones, and the like. The addition amount or blended amount of spheroidizing agent is also determined in consideration of the disappearance, the fading phenomenon, and so forth. For example, it is preferable to add a spheroidizing agent so that a residual Mg content (that is, a content of Mg that remains in a prepared cast iron) becomes from 0.01 to 0.1%, more preferably from 0.03 to 0.08%, when the entire modifier-free molten metal is taken as 100%.

Note that, as far as the configuration or number of particles of crystallizing graphite falls within the desirable range, it is optional that to what extent any one of the inoculant agents or spheroidizing agents is added.

Austenitic-Cast-Iron Cast Product

Although the austenitic cast product according to the present invention is members with desirable configuration that comprise the above-described austenitic cast iron according to the present invention, it is needless to say that their configurations, wall thicknesses, and the like, do not matter at all.

Here, although it is also possible to think of that the thickness, configuration, size, casting designs and the like of cast product have influences on the structure, cast defects and so forth of austenitic cast iron, it had been ascertained that, in the case of the austenitic cast product according to the present invention, the base turns into a stable austenite phase. Moreover, even in a case where the thickness of cast product is so thin that the molten metal is quenched and then rapidly solidified partially, the present inventors had ascertained already that it is possible to obtain desired spheroidal graphite cast irons by adjusting the addition method of an auxiliary agent or the addition timing appropriately.

The structure of austenitic cast product is divided roughly into a base structure, and a eutectic structure. A base structure according to the present invention comprises an austenite phase of Fe. A eutectic structure according to the present invention is graphite.

Generally speaking, although cast irons are classified variously depending on the forms of crystallizing graphite, being spheroidal graphite cast irons is preferable because they are good in terms of everyone of characteristics, such as mechanical characteristics, compared with those of the other cast irons. Hence, it is suitable that the austenitic cast iron according to the present invention can also comprise a spheroidal graphite cast iron.

The structure of spheroidal graphite cast iron is indexed by means of a spheroidized proportion of graphite and the number of graphite particles in general. First of all, actual austenitic cast products that are good in terms of characteristics exhibit such a spheroidized proportion of graphite, which crystallized or precipitated in the base, as 70% or more, 75% or more, or furthermore 80% or more. Next, the greater the number of graphite particles that have crystallized or precipitated is, the more desirable it is. For example, in a section whose cast-product wall thickness is 5 mm or less, it is suitable that the number of graphite particles whose particle diameter is 10 μm or more can be 50 pieces/$mm^2$ or more, 75 pieces/$mm^2$ or more, or furthermore 100 pieces/

$mm^2$ or more. Note that it is preferable that spheroidal graphite can be dispersed within base very finely. Moreover, in a section whose cast-product wall thickness is 5 mm or less, it is suitable that the number of graphite particles whose particle diameter is 5 μm or more can be 150 pieces/$mm^2$ or more, 200 pieces/$mm^2$ or more, 250 pieces/$mm^2$ or more, or furthermore 300 pieces/$mm^2$ or more. Note that it is preferable that spheroidal graphite can be dispersed within base very finely.

Note that the spheroidized proportion of graphite can be measured by means of "G 550210.7.4" as per JIS or the spheroidized-graphite-proportion judgment testing method as per old JIS "G 5502" (or the NIK method). Moreover, the number of graphite particles can be measured by means of counting the number of graphite particles per unit area.

Since the austenitic cast iron according to the present invention is more inexpensive than are conventional ones, employing it for members and the like, in which austenitic cast irons have been employed currently, makes it feasible to make them at lower cost. Therefore, the field of the utilization is not limited to the field of automobile and the field of engine, the austenitic cast product according to the present invention is utilizable for a great variety of members. In particular, the austenitic cast iron according to the present invention is excellent in terms of the stability of austenite phase in intermediate-temperature region, and in terms of the oxidation resistance under high temperature, as described above. Consequently, as for a specific application of the austenitic cast iron according to the present invention, exhaust-system component parts for automobile, and so forth, are given. This is not only because these component parts are exposed in environments with intermediate temperatures of from 500 to 600° C. that result from exhaust gases, but also because they are exposed to the sulfur oxides, nitrogen oxides, and so on, in the exhaust gases. Among them, it is desirable to use it for housings of turbochargers in which austenitic cast irons, which are equivalent to "D-2" or which are equivalent to "D-5S," have been employed mainly at present. The austenitic cast iron according to the present invention is a promising material that substitute for "D-2" or "D-5S" material, because it is better in terms of oxidation resistance than is the "D-2" material, and because it shows oxidation resistance and excellent austenite-phase stability that are equal to those of the "D-5S" material, regardless of the fact that the Ni content is less than that of the "D-5S" material. Note that it is quite natural that it is utilizable for members, which are employed in such ordinary-temperature region as at room temperature approximately, and in high-temperature regions of 700° C. or more.

So far, explanations have been made on some of the embodiment modes of the austenitic cast iron according to the present invention and the manufacturing process for the same, as well as on the austenitic-cast-iron cast product. However, the present invention is not one which is limited to the aforementioned embodiment modes. It is possible to execute the present invention in various modes, to which changes or modifications that one of ordinary skill in the art can carry out are made, within a range not departing from the gist.

EXAMPLES

Hereinafter, the present invention will be explained in detail while giving specific examples of the austenitic cast iron according to the present invention and the manufacturing process for the same, as well as those of the austenitic-cast-iron cast product.

Manufacturing Method for Test Specimens

Molten-Metal Preparation Step

Raw materials, which included C, Si, Cr, Mn, Ni and Cu (i.e., basic elements) and the balance of Fe, were blended and mixed variously, and they were air melted with a high-frequency furnace, thereby obtaining 47-kg molten metals.

Pouring Step

Each of these molten metals was poured into a casting die that had been made ready in advance. The employed casting die was a sand die. On this occasion, they were tapped at about 1,550° C., and were poured at about 1,450° C.

Solidification Step

The post-pouring molten metals were solidified by natural cooling, thereby obtaining test specimens (namely, as-cast cast products) with a predetermined configuration.

Note that the addition of an auxiliary agent, such as an inoculant agent and spheroidizing agents, was also carried out when casting the respective test specimens. The addition of the inoculant agent was carried out by adding "CALBALLOY" (containing Si—Ca—Al—Ba) produced by OSAKA SPECIAL ALLOY Co., Ltd., or "TOYOBARON BIL" (containing Si—Ca—Ba—Bi—Al) produced by TOYO DENKA Co., Ltd., in an amount of 0.4% by mass with respect to the modifier-free molten metals. Even when any of the inoculant agents were added, no great difference was observed in effects being described later. The addition of the spheroidizing agents was carried out by adding the following to the modifier-free molten metals: an Mg simple substance in an amount of 0.04% by mass or 0.07% by mass; R.E. (e.g., the misch metal was employed) in an amount of 0.05%; and an Sb simple substance in an amount of 0.0005% by mass; with respect to the modifier-free molten metals being taken as 100%. Note that the Mg amount was great because the disappearance, and the like, were taken into consideration.

The casting die being used herein was a sand die whose size was 50 mm in width×180 mm in overall length, and from which a stepped plate-shaped cast product was obtainable, stepped plate-shaped cast product whose height (or thickness) changed in five stages in the following order: (i) 50 mm (50 mm in length)→(ii) 25 mm (45 mm in length)→(iii) 12 mm (40 mm in length)→(iv) 5 mm (25 mm in length)→3 mm (20 mm in length). Moreover, type-"B" "Y"-shaped blocks as per JIS, and type-"D" "Y"-shaped blocks as per JIS were made by means of mold casting, independently of those above.

By means of the aforementioned manufacturing method, test specimens being labeled "A1" through "A9," "B1," "B2," "C1" through "C8" (i.e., comparative examples), "D1" and "E1" whose blended compositions differed one another. Table 1 and Table 2 show the blended compositions of "A1" through "A9" and "R1." Table 4 and Table 5 show the blended compositions of "B1," "B2," "D1," "C1" through "C6" and "R2." Table 7 shows the blended compositions of "R3" through "R6," "C7," "C8" and "E1."

Note that "R1" through "R6" were test specimens that were made from general-purpose cast irons, which have been heretofore used conventionally, by the same procedure as above. "R1" and "R4" were equivalent to "D-2" as per ASTM. "R2" was equivalent to "NiMn137" as per JIS. "R3" was equivalent to "D-5S" as per ASTM. "R5" was equivalent to "HiSiMoFCD" (a common name). "R6" was equivalent to "FCD450" as per JIS.

Measurement of Test Specimens (1) Analysis of Alloy Compositions

Samples, which were collected from a section of the respective test specimens with 25 mm in thickness, were analyzed compositionally by means of wet analysis, thereby obtaining analyzed compositions of the cast irons as a whole. The thus obtained compositions of the basic elements were shown as the "analyzed compositions" in the respective tables. Although only the fundamental compositions are shown in Table 7, Mg, and the like, which had been added as an auxiliary agent, were detected, though in a trace amount, respectively. Note that, in the alloy compositions, the symbol, "–," specifies any of the following; unblended, unanalyzed or unmeasured; and unanalyzable or unmeasurable.

(2) Evaluation of Structures

Figure 5:
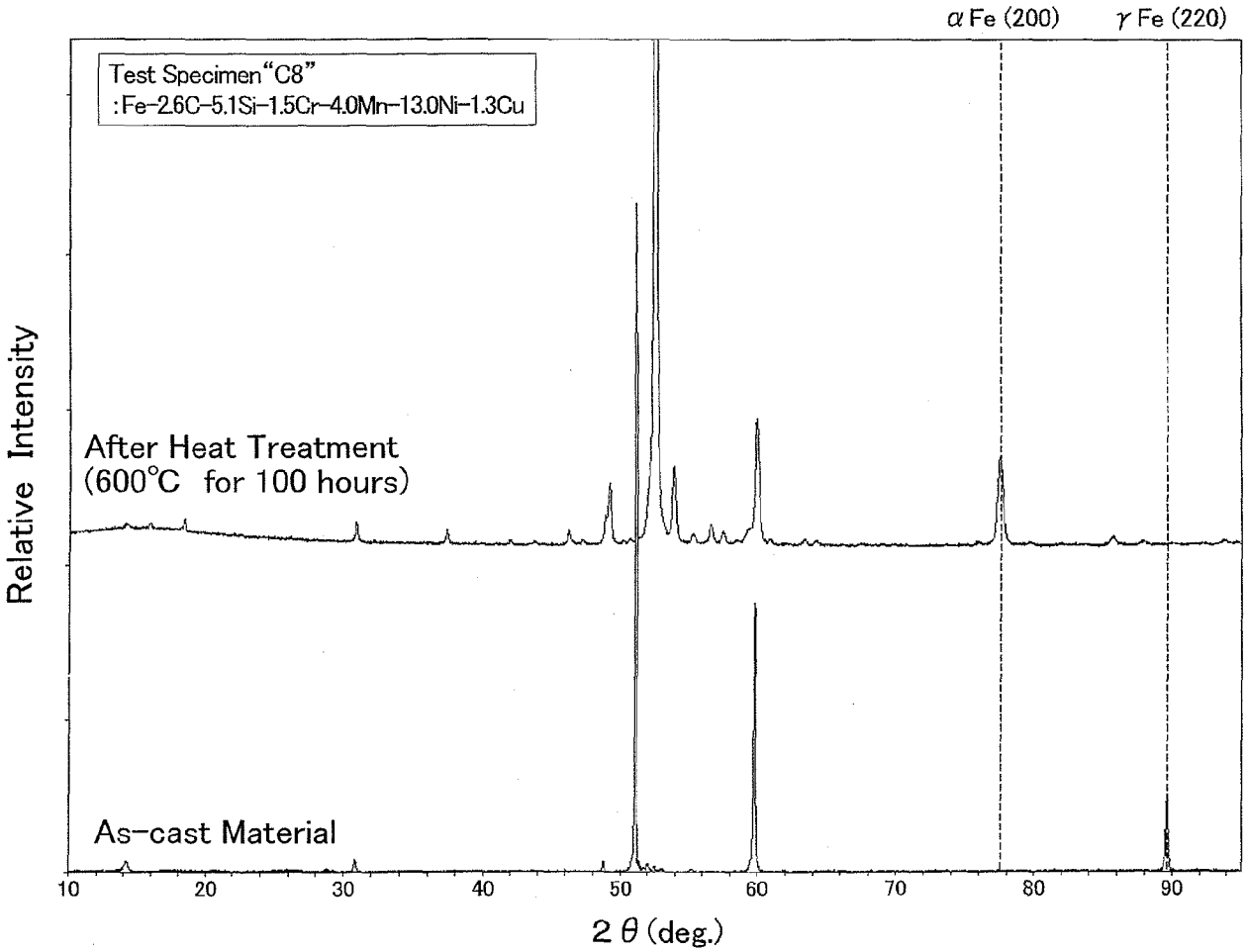
FIG. 5 illustrates X-ray diffraction peaks of an austenitic cast iron according to a comparative example.

At the beginning, an X-ray diffraction (or XRD) measurement, in which Co was used as the X-ray tubular bulb, was carried out for samples that were collected from a section of Test Specimen "C8" with 25 mm in thickness. The XRD measurement was carried out for an as-cast material and a heat-treated material that was made by retaining the former in 600° C. air for 100 hours. Results are shown in FIG. 5. In addition, the XRD measurement was carried out similarly for the respective test specimens, too, which are given in Table 1 and Table 2 as well as Table 4 and Table 5. Note that the heat treatment was carried out by retaining the respective test specimens (or as-cast materials) in 500° C. or 600° C. air for 100 hours, 200 hours or 300 hours.

Figure 6:
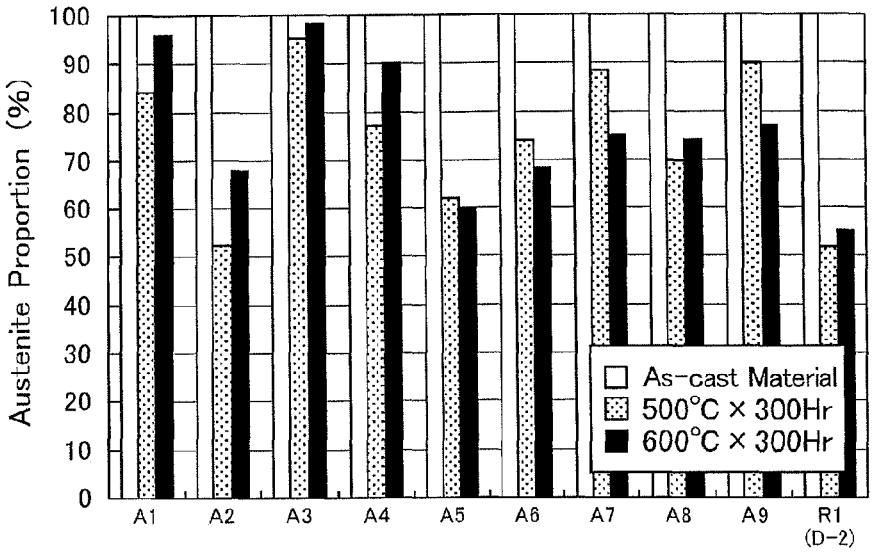
FIG. 6 is a graph that illustrates the austenite-phase stability of an austenitic cast iron according to the present invention and that of a general-purpose cast iron which has been heretofore used conventionally.

From each of the results of the XRD measurement, an austenite proportion was calculated using integrated strengths of the respective peaks of austenite phase and ferrite phase. The integrated intensities were calculated by a common method from the (220) plane's peak at around $2\theta=90°$ that indicates the presence of austenite phase, and the (200) plane's peak at around $2\theta=77°$ that indicates the presence of ferrite phase. An austenite proportion is expressed with a percentage value with units of %, namely, $I_\gamma/(I_\gamma+I_\alpha)$, when the integrated strength of the (220) plane's peak is labeled $I_\gamma$ and the other integrated strength of the (200) plane's peak is labeled $I_\alpha$. Results are shown in Table 3, Table 6, and FIG. 6.

Note that Test Specimens "R3" and "R4" maintained 100% austenite proportion, not to mention their as-cast materials, but those materials being heat-treated under any of the conditions. In Test Specimen "R5," both of the as-cast material and heat-treated material exhibited 0% austenite proportion.

For the respective test specimens given in Table 7, a structural observation was carried out by means of their microscope photographs. The microscopic observation was carried out after grounding the cross section of the respective test specimens. By means of the optical-microscope photographs, the crystallized form of eutectic graphite was examined, thereby measuring the spheroidized proportion of graphite. The spheroidized proportion of graphite was found by means of the judgment testing method according to "G 5502 (or the NIK method)" as per old JIS. Moreover, for the same samples as above, the Vickers hardness (Hv at 20 kgf) was measured at ordinary temperature. The resulting spheroidized proportion and Vickers hardness are shown in Table 8.

(3) Oxidation Resistance Test

Figure 7:
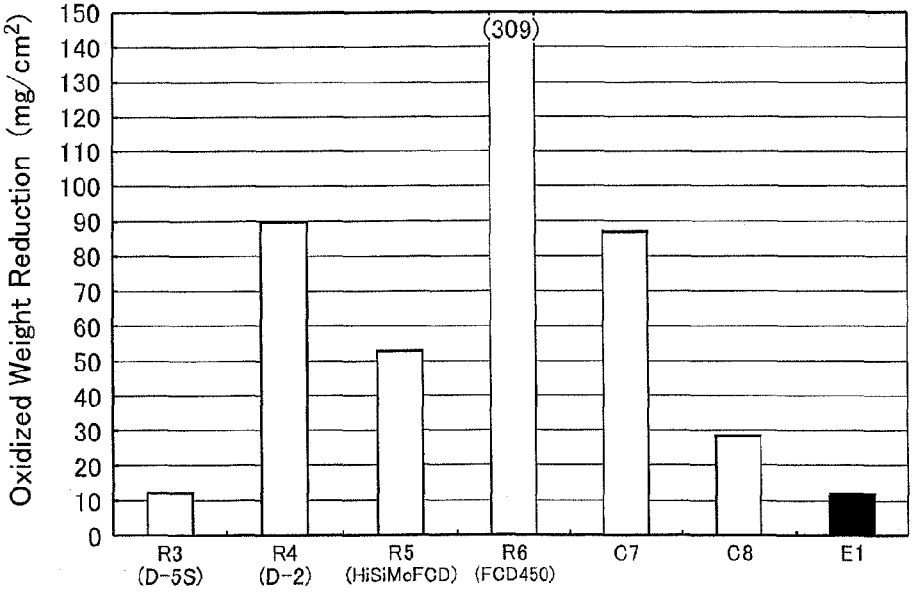
FIG. 7 is a graph that illustrates the oxidized weight reduction of an austenitic cast iron according to the present invention and that of general-purpose cast irons which have been heretofore used conventionally.

The respective test specimens given in Table 7 were evaluated for oxidation resistance by measuring their oxidized weight reductions based on "Z 2282" as per JIS. To be concrete, the respective test specimens with $\phi 20\times 20$ mm, which were collected respectively from a type-"B" "Y"-shaped block as per JIS and a type-"D" "Y"-shaped block as per JIS that had been prepared by means of mold casting, were first retained in an air atmosphere at 750° C., 800° C. or 850° C. for 100 hours. Iron balls whose shot spherical diameter was 0.4 mm were then projected to a surface of these test specimens, which had undergone the heat treatment, until oxidized films on their surfaces disappeared. Here, the oxidized weight decrement was each of the test specimens' mass decrement per unit area. The oxidized weight decrement is one which was obtained by deducting a mass of each of the test specimens after being shot from another mass of the test specimen immediately after the aforementioned heat treatment (or before being shot). Table 9 and FIG. 7 show the resulting oxidized weight decrements (i.e., number average values of the two) in the case of being heat-treated at 850° C.

Note that, when observing oxidized films, which were fallen off from the respective test specimens, the oxides were removed from the test specimen's surface after they turned into powdery shapes in Test Specimen "E1." However, in Test Specimen "R4," the oxidized films came off and then fell down as they were agglomerate.

(4) Tensile Test

Figure 8:
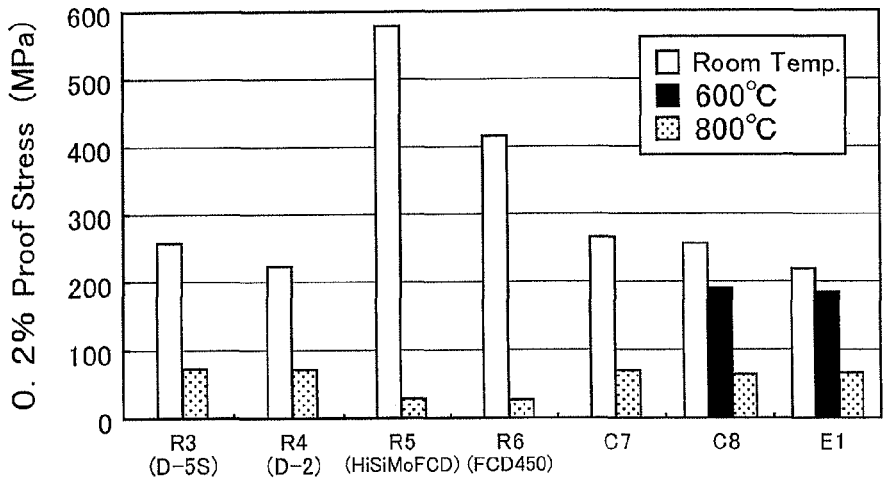
FIG. 8 is a graph that illustrates the 0.2% proof stress of an austenitic cast iron according to the present invention and that of general-purpose cast irons which have been heretofore used conventionally.
Figure 9:
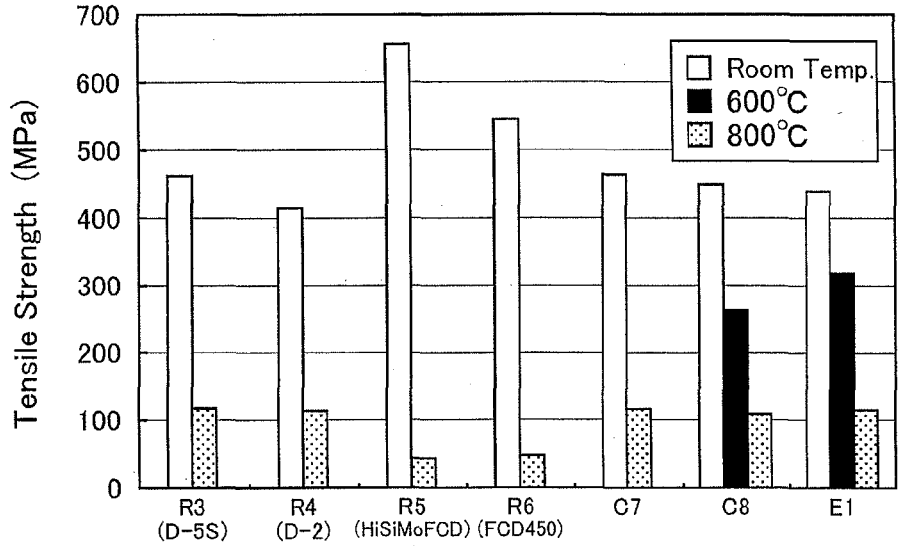
FIG. 9 is a graph that illustrates the tensile strength of an austenitic cast iron according to the present invention and that of general-purpose cast irons which have been heretofore used conventionally.
Figure 10:
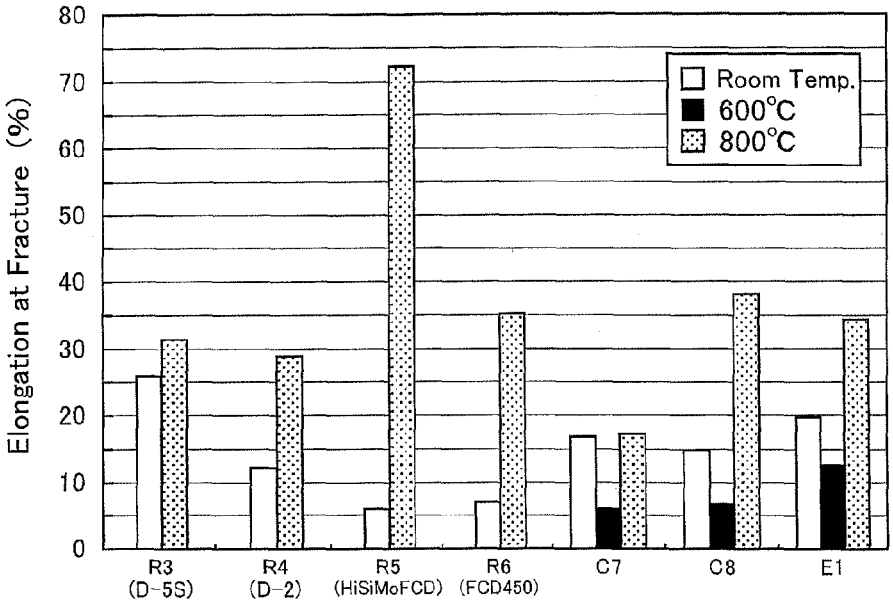
FIG. 10 is a graph that illustrates the elongation at fracture of an austenitic cast iron according to the present invention and that of general-purpose cast irons which have been heretofore used conventionally.

A test was carried out at room temperature (or R. T., namely, 25° C.), 600° C. or 800° C. in conformity to "G 0567" as per JIS for each of the test specimens given in Table 7, thereby measuring the proof stress, tensile strength and elongation. Results are shown in Table 8, and FIG. 8 through FIG. 10. Note that round-bar test specimens with $\phi 6$ mm were employed for the samples, and that the round-bar test specimens were made respectively from out of a perpendicularly-cross-sectional rectangle-shaped portion of a type-"B" "Y"-shaped block as per JIS that was made by means of mold casting.

(5) Thermal Stress Test

Figure 11:
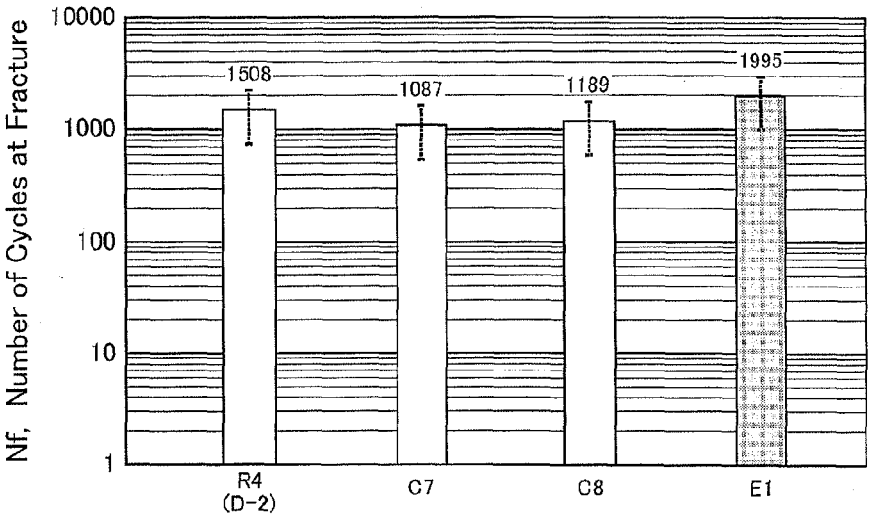
FIG. 11 is a graph that illustrates the thermal-fatigue life (or the number of cycles at fracture) of an austenitic cast iron according to the present invention and that of general-purpose cast irons which have been heretofore used conventionally.

The thermal-fatigue strength or thermal-fatigue life of each of Test Specimens "R4," "C7," "C8" and "E1" was measured using round-bar test specimens with $\phi 8$ mm that were collected respectively from a type-"B" "Y"-shaped block as per JIS that was made by means of mold casting. In this test, the following number of cycles were examined while changing the temperature of the test specimens with a predetermined constrained rate repetitively between 800° C. and 200° C.: the number of cycles at which stress lowered by 10%; the number of cycles at which stress lowered by 25%; the number of cycles at which stress lowered by 50%; and the number of cycles at which the test specimens fractured apart (i.e., the number of cycles at fracture). Results of this test are shown in Table 9 and FIG. 11. Note that the proportion of lowering stress was taken against a reference at which a tensile-side peak stress was equal to a peak stress when the number of cycles was 2.

Evaluations

As illustrated in FIG. 5, although Test Specimen "C8" comprised virtually 100% austenite phase (or γ phase) in the as-cast state, almost all of the austenite (or γFe) transformed into ferrite (or αFe) when it was retained in 600° C. air for 100 hours. This is believed to result from the fact that not only the Ni amount was too low but also the Mn amount was insufficient, although the oxidation resistance was excellent at 850° C. because the Si content was 5.1%.

In any one of Test Specimens "A1" through "A9," the post-heat-treatment austenite proportion exceeded 50%. That is, it was understood that they exhibited the austenite-phase stability that was equivalent to or more than that of "D-2" (i.e., Test Specimen "R1"), one of general-purpose materials that have been heretofore used conventionally. In particular, the austenite proportion was 60% or more in any one of Test Specimens "A1" through "A9" after they were retained at 600° C. for 300 hours.

With regard to the Ni content, it was understood that, from the calculated results of the austenite proportion for Test Specimens "B1," "B2" and "C1" as well as Test Specimens "D1" and "C2" (see Table 6), the stability of austenite phase in intermediate-temperature region declined greatly (in particular, in the case of undergoing the heat treatment for a long period of time) when the Ni content was 16% or less. Moreover, although Test Specimen "C3" included Ni in an amount of 16.1% only in the analyzed composition, the austenite-phase stability was high. This is because the Si content was lowered down to 3.2% in the targeted composition. That is, it was understood that, unless the Si content is reduced in order to sacrifice the oxidation resistance, the austenite-phase stability cannot be maintained when the Ni content falls in a range of less than 17%.

In particular, in Test Specimens "A1," "A3," "A4," "A6" through "A9," "B1" and "D1" whose Ni amount was from 19.5 to 21.5%, the austenite proportion was 60% in any one of the cases after they were retained in intermediate-temperature region (i.e., 500° C. or 600° C.) for a long period of time (i.e., 300 hours). Thus, they were excellent especially in term of the austenite-phase stability in intermediate-temperature region.

In any one of Test Specimens "A2," "A5" through "A7," "B1" and "B2," the Si content was 5.1% in the targeted composition. Although the stability of austenite phase tended to be likely to decline in intermediate-temperature region when the Si content was higher, setting (Ni+Mn), the sum of the Ni and Mn addition amounts, at 21% or more led to keeping the austenite-phase stability in Test Specimen "B2." Moreover, as (Ni+Mn) was set in Test Specimens "A2," "A5" through "A7" and "B1," setting it at 23% or more, or furthermore at 24% or more, led to further upgrading the austenite-phase stability in intermediate-temperature region. In addition, from the results on Test Specimens "A3," "A4" and "D1," it was understood that (Ni+Mn) can be reduced down to 27% or less, furthermore to 26% or less.

Moreover, Test Specimen "E1" had the same targeted composition as that of Test Specimen "A9." As illustrated in FIG. 7, Test Specimen "E1," which had undergone the heat treatment at 850° C., exhibited an oxidized weight reduction that was equal to that of "D-5S" (i.e., Test Specimen "R3") whose oxidation resistance is said to be best among general-purpose materials that have been heretofore used conventionally. Moreover, since the oxidation resistance at 850° C. was affected greatly by the Si addition amount as can be seen from FIG. 1, it is possible to predict that Test Specimens "A1," "A2" and "A5" through "A8," whose Si content was comparable with or more than that of Test Specimen "A9," can be excellent in terms of the oxidation resistance at 850° C. so that they exhibit oxidation resistance that is comparable with or better than that of Test Specimen "R3." In addition, from FIG. 1, the increment in oxidized weight reduction was about 43 mg/cm$^2$ in a case where the Si content was reduced by 1%. Consequently, it is predicted that, in Test Specimen "A3," the oxidized weight reduction can be 35 mg/cm$^2$ approximately at the highest even when the Si content is 4.16% in the analyzed composition. That is, it was understood that Test Specimens "A1" through "A9" exhibited oxidation resistance and excellent austenite-phase stability that were equivalent to those of "D-5S" (i.e., Test Specimen "R3"), which included Ni in a greater amount, by setting the contents of C, Si, Cr, Mn and Cu in an appropriate range, respectively, even when keeping the Ni content less.

Moreover, since Test Specimen "B1," "B2" and "D1" had an Si content of 4.2% or more, or furthermore 5.1% or more, in the analyzed composition, the oxidation resistance at 850° C. was high sufficiently as shown in Table 6.

In addition, regarding the mechanical characteristics (e.g., the proof stress, tensile strength and elongation at fracture) and the thermal-fatigue life as well, Test Specimen "E1" exhibited higher characteristics, respectively. So, this is predicted to hold true similarly for Test Specimens "A1" through "A9," "B1," "B2" and "D1," too. Therefore, it is possible to say that, not only from the oxidation resistance under high temperature and austenite-phase stability in intermediate-temperature region but also from the viewpoint of the mechanical characteristics and thermal-fatigue life, the austenitic cast irons according to Test Specimens "A1" through "A9," "B1," "B2" and "D1" fall in an employable range as a housing, and the like, for "VNT" turbocharger, for instance.

TABLE 1

| Test Specimen | Blended (or Targeted) Composition (% by mass) * | | | | | | Analyzed Composition (% by mass) | | | | | |
|---|---|---|---|---|---|---|---|---|---|---|---|---|
| No. | C | Si | Cr | Mn | Ni | Cu | C | Si | Cr | Ni | Mn | Cu |
| A1 | 2.53 | 4.7 | 1.5 | 4.5 | 20.0 | 1.3 | 2.47 | 4.89 | 1.35 | 19.98 | 4.58 | 1.29 |
| A2 | 2.46 | 5.1 | 2.0 | 5.0 | 19.0 | 1.0 | 2.44 | 5.26 | 1.85 | 19.09 | 5.16 | 1.01 |
| A3 | 2.59 | 4.3 | 1.0 | 4.0 | 21.0 | 1.6 | 2.58 | 4.16 | 1.04 | 21.15 | 4.13 | 1.58 |
| A4 | 2.59 | 4.3 | 2.0 | 5.0 | 21.0 | 1.6 | 2.55 | 4.39 | 1.89 | 20.95 | 4.95 | 1.59 |
| A5 | 2.46 | 5.1 | 1.0 | 4.0 | 19.0 | 1.0 | 2.59 | 5.30 | 0.91 | 19.00 | 4.14 | 1.00 |
| A6 | 2.44 | 5.1 | 2.0 | 5.0 | 20.0 | 1.0 | 2.43 | 5.26 | 1.80 | 19.98 | 5.06 | 1.02 |
| A7 | 2.44 | 5.1 | 1.0 | 4.0 | 20.0 | 1.0 | 2.33 | 5.37 | 0.93 | 20.17 | 4.12 | 1.00 |

TABLE 1-continued

| Test Specimen | Blended (or Targeted) Composition (% by mass) * | | | | | | Analyzed Composition (% by mass) | | | | | |
|---|---|---|---|---|---|---|---|---|---|---|---|---|
| No. | C | Si | Cr | Mn | Ni | Cu | C | Si | Cr | Ni | Mn | Cu |
| A8 | 2.50 | 4.8 | 1.5 | 4.0 | 20.0 | 1.3 | 2.49 | 4.93 | 1.52 | 20.17 | 4.03 | 1.26 |
| A9 | 2.50 | 4.8 | 1.5 | 4.0 | 20.0 | 1.3 | 2.50 | 4.97 | 1.52 | 20.27 | 3.97 | 1.26 |
| R1 | 2.80 | 2.7 | 2.3 | 1.0 | 20.5 | — | 2.90 | 3.00 | 1.80 | 19.30 | 0.90 | — |

(Note)

* The balance is Fe, inevitable impurities, and modifier elements.

TABLE 2

| Test Specimen | Blended (Targeted) Composition (% by mass) | | | Analyzed Composition (% by mass) | | | | | | | | | |
|---|---|---|---|---|---|---|---|---|---|---|---|---|---|
| No. | S | Mg | Sb | P | S | Mg | Ce | Al | Sn | Ti | Sb | Mo | Zn |
| A1 | 0.01 | 0.07 | 0.0005 | 0.010 | 0.015 | 0.094 | 0.002 | 0.013 | 0.007 | 0.021 | 0.005 | 0.005 | 0.002 |
| A2 | 0.01 | 0.07 | 0.0005 | 0.012 | 0.013 | 0.098 | 0.003 | 0.015 | 0.008 | 0.022 | 0.005 | 0.006 | 0.002 |
| A3 | 0.01 | 0.07 | 0.0005 | 0.009 | 0.014 | 0.100 | 0.002 | 0.013 | 0.005 | 0.019 | 0.005 | 0.005 | 0.002 |
| A4 | 0.01 | 0.07 | 0.0005 | 0.012 | 0.013 | 0.094 | 0.004 | 0.015 | 0.007 | 0.024 | 0.004 | 0.006 | 0.003 |
| A5 | 0.01 | 0.07 | 0.0005 | 0.013 | 0.011 | 0.097 | 0.001 | 0.013 | 0.006 | 0.022 | 0.005 | 0.005 | 0.002 |
| A6 | 0.01 | 0.07 | 0.0005 | 0.012 | 0.009 | 0.100 | 0.004 | 0.014 | 0.008 | 0.026 | 0.005 | 0.006 | 0.004 |
| A7 | 0.01 | 0.07 | 0.0005 | 0.012 | 0.014 | 0.097 | 0.001 | 0.013 | 0.007 | 0.024 | 0.005 | 0.004 | 0.002 |
| A8 | 0.01 | 0.04 | 0.0005 | 0.020 | 0.012 | 0.052 | 0.013 | 0.015 | 0.007 | 0.027 | 0.004 | 0.004 | 0.004 |
| A9 | 0.01 | 0.07 | 0.0005 | 0.019 | 0.013 | 0.078 | 0.000 | 0.012 | 0.008 | 0.030 | 0.005 | 0.005 | 0.004 |
| R1 | 0.01 | 0.04 | — | 0.040 | 0.014 | 0.035 | — | — | — | — | — | — | — |

TABLE 3

| | | Austenite Proportion (%) | | | | | | | | | |
|---|---|---|---|---|---|---|---|---|---|---|---|
| Test Specimen No. | | A1 | A2 | A3 | A4 | A5 | A6 | A7 | A8 | A9 | R1 |
| As-cast Material | | 100 | 100 | 100 | 100 | 100 | 100 | 100 | 100 | 100 | 100 |
| Heat-treated Material | 500° C. for 100 hours | 83 | 97 | 86 | 95 | 94 | 97 | 87 | 98 | 94 | 100 |
| | 500° C. for 200 hours | 94 | 69 | 90 | 88 | 92 | 77 | 87 | 79 | 89 | 88 |
| | 500° C. for 300 hours | 84 | 52 | 95 | 77 | 62 | 74 | 88 | 70 | 90 | 52 |
| | 600° C. for 100 hours | 96 | 87 | 99 | 98 | 83 | 92 | 86 | 96 | 89 | 71 |
| | 600° C. for 200 hours | 90 | 84 | 93 | 98 | 77 | 82 | 90 | 95 | 88 | 68 |
| | 600° C. for 300 hours | 96 | 68 | 98 | 90 | 60 | 68 | 75 | 74 | 77 | 55 |

TABLE 4

| Test Specimen | Blended (or Targeted) Composition (% by mass) * | | | | | | Analyzed Composition (% by mass) | | | | | |
|---|---|---|---|---|---|---|---|---|---|---|---|---|
| No. | C | Si | Cr | Mn | Ni | Cu | C | Si | Cr | Ni | Mn | Cu |
| B1 | 2.65 | 5.1 | 1.5 | 4.0 | 20.0 | 1.3 | 2.64 | 5.10 | 1.48 | 20.64 | 4.06 | 1.26 |
| B2 | 2.65 | 5.1 | 1.5 | 4.0 | 17.0 | 1.3 | 2.63 | 5.11 | 1.48 | 17.74 | 4.06 | 1.32 |
| C1 | 2.65 | 5.1 | 1.5 | 4.0 | 15.0 | 1.3 | 2.64 | 5.10 | 1.46 | 15.66 | 4.02 | 1.37 |
| D1 | 3.00 | 4.0 | 1.5 | 5.5 | 20.0 | 1.5 | 2.81 | 4.29 | 1.49 | 20.48 | 5.57 | 1.46 |
| C2 | 3.00 | 4.0 | 1.5 | 5.5 | 15.0 | 1.5 | 2.99 | 4.18 | 1.48 | 15.85 | 5.57 | 1.52 |
| C3 | 3.40 | 3.2 | 3.0 | 8.0 | 16.0 | 1.6 | 3.39 | 3.37 | 2.95 | 16.10 | 8.06 | 1.62 |
| C4 | 2.70 | 5.1 | 1.5 | 4.0 | 13.0 | 1.5 | 2.70 | 5.10 | 1.50 | 13.20 | 4.00 | 1.40 |
| C5 | 2.70 | 5.1 | 1.5 | 2.5 | 13.0 | 1.5 | 2.80 | 5.15 | 1.61 | 13.32 | 2.60 | 1.48 |
| C6 | 3.00 | 4.0 | 1.5 | 5.5 | 13.0 | 1.5 | 2.98 | 4.00 | 1.50 | 12.90 | 5.40 | 1.50 |
| R2 | 3.00 | 2.4 | 0.1 | 7.5 | 13.5 | — | 3.00 | 2.40 | 0.20 | 13.50 | 7.40 | — |

(Note)

* The balance is Fe, inevitable impurities, and modifier elements.

TABLE 5

| Test Specimen | Blended (Targeted) Composition (% by mass) | | | Analyzed Composition (% by mass) | | | | | | | | | |
|---|---|---|---|---|---|---|---|---|---|---|---|---|---|
| No. | S | Mg | Sb | P | S | Mg | Ce | Al | Sn | Ti | Sb | Mo | Zn |
| B1 | 0.01 | 0.04 | 0.0005 | 0.024 | 0.013 | 0.047 | 0.012 | 0.016 | 0.010 | 0.032 | 0.005 | 0.006 | 0.009 |
| B2 | 0.01 | 0.04 | 0.0005 | 0.025 | 0.014 | 0.042 | 0.009 | 0.014 | 0.009 | 0.035 | 0.006 | 0.006 | 0.008 |
| C1 | 0.01 | 0.04 | 0.0005 | 0.024 | 0.012 | 0.039 | 0.010 | 0.014 | 0.009 | 0.029 | 0.006 | 0.005 | 0.008 |
| D1 | 0.01 | 0.04 | 0.0005 | 0.034 | 0.010 | 0.052 | 0.010 | 0.017 | 0.008 | 0.042 | 0.006 | 0.008 | 0.008 |
| C2 | 0.01 | 0.04 | 0.0005 | 0.033 | 0.013 | 0.050 | 0.011 | 0.015 | 0.007 | 0.038 | 0.006 | 0.006 | 0.009 |
| C3 | 0.01 | 0.04 | 0.0005 | 0.034 | 0.010 | 0.045 | 0.015 | 0.018 | 0.004 | 0.042 | 0.005 | 0.008 | 0.012 |
| C4 | 0.01 | 0.04 | 0.0005 | 0.016 | 0.010 | 0.057 | 0.005 | 0.021 | 0.002 | — | — | — | — |
| C5 | 0.01 | 0.04 | 0.0005 | 0.030 | 0.030 | 0.060 | — | — | — | — | — | — | — |
| C6 | 0.01 | 0.04 | 0.0005 | 0.030 | 0.030 | 0.060 | 0.03 | — | — | — | — | — | — |
| R2 | 0.01 | 0.04 | — | 0.020 | 0.004 | 0.031 | — | — | — | — | — | — | — |

TABLE 6

| Test Specimen No. | | B1 | B2 | C1 | D1 | C2 | C3 | C4 | C5 | C6 | R2 |
|---|---|---|---|---|---|---|---|---|---|---|---|
| | | Austenite Proportion (%) | | | | | | | | | |
| As-cast Material | | 100 | 100 | 100 | 100 | 100 | 100 | 100 | 100 | 100 | 100 |
| Heat-teated Material | 500° C. for 100 hours | 83 | 80 | 80 | 98 | 43 | 74 | 84 | 36 | 50 | 95 |
| | 500° C. for 200 hours | 79 | 86 | 73 | 85 | 53 | 71 | 50 | 34 | 52 | 94 |
| | 500° C. for 300 hours | 81 | 62 | 38 | 80 | 30 | 80 | 26 | 0 | 25 | 89 |
| | 600° C. for 100 hours | 96 | 84 | 7 | 96 | 82 | 100 | 0 | 47 | 72 | 100 |
| | 600° C. for 200 hours | 96 | 66 | 22 | 98 | 86 | 82 | 0 | 0 | 86 | 100 |
| | 600° C. for 300 hours | 84 | 62 | 14 | 94 | 70 | 100 | 27 | 0 | 74 | 100 |
| | | Oxidized Weight Reduction ($mg/cm^2$) | | | | | | | | | |
| 850° C. for 100 hours | | 12 | — | 15.8 | 25.1 | 42 | — | — | 35.3 | — | — |

TABLE 7

| Test Specimen | Blended (or Targeted) Composition (% by mass) | | | | | | Analyzed Composition (% by mass) | | | | | |
|---|---|---|---|---|---|---|---|---|---|---|---|---|
| No. | C | Si | Cr | Mn | Ni | Cu | C | Si | Cr | Mn | Ni | Cu |
| R3 | 2.0 | 5.0 | 2.0 | 0.6 | 35.0 | — | 2.00 | 4.90 | 1.90 | 0.53 | 35.80 | — |
| R4 | 2.8 | 2.7 | 2.3 | 1.0 | 20.5 | — | 2.90 | 3.00 | 1.80 | 0.90 | 19.30 | — |
| R5 | 3.5 | 4.1 | — | — | — | (Mo: 0.5%) | 3.10 | 4.12 | — | — | — | — |
| R6 | 3.2 | 2.7 | 0.0 | 0.4 | — | — | 3.46 | 2.74 | — | 0.44 | — | — |
| C7 | 3.0 | 4.0 | 1.5 | 5.5 | 13.0 | 1.5 | 3.00 | 4.00 | 1.50 | 5.40 | 13.10 | 1.50 |
| C8 | 2.6 | 5.1 | 1.5 | 4.0 | 13.0 | 1.3 | 2.65 | 5.08 | 1.48 | 4.02 | 13.15 | 1.36 |
| E1 | 2.5 | 4.8 | 1.5 | 4.0 | 20.0 | 1.3 | 2.53 | 4.80 | 1.53 | 4.11 | 19.98 | 1.28 |

(Note)
"R4" had the same material quality as that of "R1."

TABLE 8

| Test Specimen | Structural Evaluation | | Results of Tensile Test | | | | | | | | |
|---|---|---|---|---|---|---|---|---|---|---|---|
| | Hardness | Spheroidized | 0.2% Proof Stress (MPa) | | | Tensile Strength (MPa) | | | Elongation (%) | | |
| No. | Hv | Proportion (%) | R.T. | 600° C. | 800° C. | R.T. | 600° C. | 800° C. | R.T. | 600° C. | 800° C. |
| R3 | 145 | 92 | 257 | — | 73 | 463 | — | 116 | 26 | — | 31 |
| R4 | 155 | 87 | 223 | — | 72 | 415 | — | 113 | 12 | — | 29 |
| R5 | 220 | 81 | 578 | — | 28 | 656 | — | 43 | 6 | — | 72 |
| R6 | 185 | 86 | 416 | — | 27 | 546 | — | 48 | 7 | — | 35 |
| C7 | 184 | 84 | 265 | — | 70 | 463 | — | 115 | 17 | 6 | 17 |
| C8 | 188 | 80 | 256 | 190 | 64 | 449 | 263 | 108 | 15 | 7 | 38 |
| E1 | 174 | 72 | 219 | 185 | 66 | 439 | 319 | 114 | 20 | 13 | 34 |

TABLE 9

| Test Specimen No. | Oxidized Weight Reduction (mg/cm$^2$) 850° C. | Thermal-stress Test (200° C. <- - -> 800° C.) 30% Constrained Rate | | | |
|---|---|---|---|---|---|
| | | Stress Lowered by 10% | Stress Lowered by 25% | Stress Lowered by 50% | Fractured Apart |
| R3 | 12 | — | — | — | — |
| R4 | 90 | 1346 | 1373 | 1402 | 1508 |
| R5 | 53 | — | — | — | — |
| R6 | 309 | — | — | — | — |
| C7 | 87 | 1042 | 1059 | 1076 | 1087 |
| C8 | 28 | 1156 | 1164 | 1176 | 1189 |
| E1 | 12 | 1587 | 1660 | 1754 | 1995 |

Manufacture of Test Specimens "F1" Through "F3"

In the same manner as the above-mentioned manufacturing method, Test Specimens"F1" through"F3" whose blended compositions differed one another were manufactured.

Measurements of Test Specimens "F1" Through "F3"

In the same manner as the above-mentioned procedures, the analysis of alloy composition, the structural evaluation, the Vickers hardness measurement, and the tensile test were carried out. Results are given in Tables 10 through 12. Note that, in the tensile test, the room temperature was set at 23° C., and that reductions of area were also calculated in addition to the proof stresses, tensile strengths and elongations.

Evaluation

Any one of Test Specimens according to "F1" through "F3" was excellent in terms of ductility and had hardness that was suitable for working, because the values of the elongation and reduction of area were great.

Test Specimen "F3," in which the Si amount, Cr amount and Mn amount were less but the Ni amount and Cu amount were greater than those of Test Specimen "F1," had a hardness that was reduced less than that of Test Specimen "F1." On the other hand, Test Specimen "F2," in which the Si amount, Cr amount and Mn amount were greater but the Ni amount and Cu amount were less than those of Test Specimen "F1," had a hardness that rose more than that of Test Specimen "F1." This is because, in the alloy system according to the present invention, the addition of Cr has a tendency to contribute to upgrading the hardness, and the additions of Ni and Cu have a tendency to contribute to reduce the hardness, respectively, as can be also apparent from FIG. 4.

It was understood from the above results that the austenitic cast irons according to Test Specimens "A1" through "A9," "B1," "B2," "D1," and "E1," in which the contents of the respective alloying elements fall in their appropriate ranges, exhibit hardness and ductility that are suitable for working.

In particular, it was understood that austenitic cast irons, which can demonstrate oxidation resistance under high temperature and the stability of austenite phase in intermediate-temperature region and additionally mechanical characteristics in well balanced manners, are obtainable by means of setting the C amount at from 2.2 to 2.8%; the Si amount at from 4.3 to 5.1%; the Cr amount at from 1 to 2%; the Mn amount at from 4 to 5%; the Ni amount at from 19 to 21%; and the Cu amount at from 1 to 1.6%.

Moreover, it was understood from the results on "E1" and "F1" through "F3" that austenitic cast irons, which are excellent in terms of, not to mention the austenite-phase stability, workability as well, are obtainable by means of setting the Si amount at from 4.4 to 5.1%, or furthermore from 4.4 to 4.9%; the Cr amount at from 1.2 to 1.8%, or furthermore from 1.2 to 1.6%; the Mn amount at from 4.0 to 4.9%, or furthermore from 4.0 to 4.5%; the Ni amount at from 19 to 21%, or furthermore from 19.5 to 21%; and the Cu amount at from 1.1 to 1.6%, or furthermore from 1.2 to 1.6%.

TABLE 10

| Test Specimen No. | Analyzed Composition (% by mass) | | | | | | | |
|---|---|---|---|---|---|---|---|---|
| | C | Si | Cr | Mn | Ni | Cu | P | S |
| F1 | 2.56 | 4.82 | 1.49 | 4.46 | 19.82 | 1.38 | 0.058 | 0.011 |
| F2 | 2.57 | 5.05 | 1.76 | 4.86 | 19.19 | 1.17 | 0.059 | 0.008 |
| F3 | 2.55 | 4.48 | 1.20 | 4.06 | 20.87 | 1.58 | 0.053 | 0.009 |

| Test Specimen No. | Analyzed Composition (% by mass) | | | | | | | |
|---|---|---|---|---|---|---|---|---|
| | Mg | Ce | Al | Sn | Ti | Sb | Mo | Zn |
| F1 | 0.092 | 0.002 | 0.014 | 0.000 | 0.030 | 0.007 | 0.002 | 0.035 |
| F2 | 0.091 | 0.002 | 0.012 | 0.002 | 0.033 | 0.007 | 0.003 | 0.047 |
| F3 | 0.094 | 0.001 | 0.012 | 0.000 | 0.027 | 0.007 | 0.002 | 0.055 |

TABLE 11

| Test Specimen No. | Structural Evaluation | |
|---|---|---|
| | Hardness Hv | Spheroidized Proportion (%) |
| F1 | 186 | 87.0 |
| F2 | 198 | 80.6 |
| F3 | 166 | 89.1 |

TABLE 12

| Test Specimen No. | Results of Tensile Test: 0.2% Proof Stress (MPa) R.T. | 600° C. | 800° C. | Tensile Strength (MPa) R.T. | 600° C. | 800° C. |
|---|---|---|---|---|---|---|
| F1 | 245.7 | 194.3 | 73.3 | 383.7 | 267.0 | 120.3 |
| F2 | 260.0 | 199.0 | 74.3 | 379.7 | 291.3 | 121.0 |
| F3 | 225.3 | 182.0 | 71.7 | 397.3 | 244.7 | 114.3 |

| Test Specimen No. | Elongation at Fracture (%) R.T. | 600° C. | 800° C. | Reduction of Area (%) R.T. | 600° C. | 800° C. |
|---|---|---|---|---|---|---|
| F1 | 14.4 | 5.9 | 28.6 | 12.0 | 9.2 | 33.8 |
| F2 | 8.5 | 6.8 | 35.0 | 11.6 | 6.5 | 37.0 |
| F3 | 18.5 | 5.7 | 26.3 | 15.8 | 8.2 | 29.9 |

The invention claimed is:

1. An austenitic cast iron, comprising:

basic elements comprising carbon (C), silicon (Si), chromium (Cr), nickel (Ni), manganese (Mn) and copper (Cu); and the balance comprising iron (Fe), inevitable impurities and optionally a trace-amount modifier element;

it is an austenitic cast iron being a cast iron that is structured by a base comprising an Fe alloy in which an austenite phase makes a major phase in ordinary-temperature region;

wherein said basic elements fall within compositional ranges that satisfy the following conditions when the entirety of said cast iron is taken as 100% by mass (hereinafter being simply expressed as "%"):

C: from 2.3 to 2.81%;

Si: from 4.97 to 5.4%;

Cr: from 0.9 to 1.9%;

Mn: from 3.97 to 5.6%;

Ni: from 19.98 to 21.5%; and

Cu: from 1.0 to 1.6%, and an austenite proportion is 70% or more after being retained at 500° C. for 300 hours in air after being cast.

2. The austenitic cast iron as set forth in claim 1, wherein a sum of said Mn and Ni is from 23.95 to 26.05%.

3. The austenitic cast iron as set forth in claim 1, wherein said Ni is from 19.98 to 21.15%.

4. The austenitic cast iron as set forth in claim 1, wherein said Ni is from 20.95 to 21.5%.

5. The austenitic cast iron as set forth in claim 1, wherein said impurities when present are 0.05% by mass or less when the entirety of said cast iron is taken as 100% by mass.

6. The austenitic cast iron as set forth in claim 1, wherein said trace-amount modifier element is present, and said trace-amount modifier element is at least one element selected from the group consisting of Mg, a rare earth element, Al, Ca, Ba, Bi, Sb, Sn, Ti, Zr, Mo, V, W, Nb and N.

7. The austenitic cast iron as set forth in claim 6, wherein a total content of said trace-amount modifier element is within a range of from greater than 0% to 1% or less when the entirety of said cast iron is taken as 100% by mass.

8. The austenitic cast iron as set forth in claim 6, wherein said trace-amount modifier element is at least Sb.

9. The austenitic cast iron as set forth in claim 8, wherein said trace-amount modifier element additionally includes at least one element selected from the group consisting of Mg, Ca, Bi, Ba, Sn and a rare earth element.

10. The austenitic cast iron as set forth in claim 9, wherein a total content of said trace-amount modifier elements is within a range of from greater than 0% to 1% by mass or less when the entirety of said cast iron is taken as 100% by mass.

11. A component part for exhaust system, being characterized in that the component part comprises the austenitic cast iron as set forth in claim 1.

12. The exhaust-system component part as set forth in claim 11 being a housing for variable nozzle turbocharger.

13. A manufacturing process for austenitic cast product, the manufacturing process being characterized in that it comprises:

a molten-metal preparation step of preparing a molten metal with the compositional range as set forth in claim 1;

a pouring step of pouring the molten metal into a casting die; and a solidification step of cooling the molten metal that has been poured into the casting die, and then solidifying the molten metal;

wherein a cast product comprising the austenitic cast iron as set forth in claim 1 is obtained.

14. The manufacturing process for austenitic cast product as set forth in claim 13, further including an auxiliary-agent addition step of adding an auxiliary agent, which includes at least one member being selected from the group consisting of inoculant agents that make cores of graphite to be crystallized or precipitated, and spheroidizing agents that facilitate spheroidizing of the graphite, to the modifier-free molten metal directly or indirectly before said pouring step or during said pouring step.

* * * * *